US010556771B2

(12) United States Patent
Blaszczak et al.

(10) Patent No.: US 10,556,771 B2
(45) Date of Patent: Feb. 11, 2020

(54) ONE-PIECE HOSE GUIDE FOR HOSE REEL DECK BOX

(71) Applicant: THE AMES COMPANIES, INC., Camp Hill, PA (US)

(72) Inventors: Gregory J. Blaszczak, Hummelstown, PA (US); Peter Arcati, Dillsburg, PA (US)

(73) Assignee: The Ames Companies, Inc., Camp Hill, PA (US)

( * ) Notice: Subject to any disclaimer, the term of this patent is extended or adjusted under 35 U.S.C. 154(b) by 0 days.

(21) Appl. No.: 15/791,203

(22) Filed: Oct. 23, 2017

(65) Prior Publication Data

US 2018/0044130 A1 Feb. 15, 2018

Related U.S. Application Data

(62) Division of application No. 13/309,590, filed on Dec. 2, 2011, now Pat. No. 9,796,558.

(51) Int. Cl.
*B65H 75/44* (2006.01)

(52) U.S. Cl.
CPC ..... *B65H 75/441* (2013.01); *B65H 75/4405* (2013.01); *B65H 75/4407* (2013.01); *B65H 75/4471* (2013.01); *B65H 75/4478* (2013.01); *B65H 75/4494* (2013.01); *B65H 2701/33* (2013.01)

(58) Field of Classification Search
CPC ..... B65H 75/4402; B65H 75/4405; B65H 75/4407; B65H 75/441; Y10T 137/6954
USPC ..... 248/70
See application file for complete search history.

(56) References Cited

U.S. PATENT DOCUMENTS

| | | | | |
|---|---|---|---|---|
| 2,512,756 | A * | 6/1950 | Wasserman | B65H 75/403 242/397.4 |
| 2,595,655 | A * | 5/1952 | Hannay | B65H 75/38 137/355.2 |
| 2,606,067 | A * | 8/1952 | Roark | A62C 25/005 137/355.17 |
| 5,758,685 | A * | 6/1998 | Tisbo | B65H 75/403 137/355.26 |
| 5,988,552 | A * | 11/1999 | Tisbo | B65H 75/403 137/355.26 |
| 6,050,291 | A | 4/2000 | Whitehead et al. | |
| D448,652 | S | 10/2001 | Spear et al. | |
| 6,742,740 | B2 * | 6/2004 | Tisbo | B65H 75/40 137/355.26 |
| 6,877,687 | B2 | 4/2005 | Moon et al. | |
| D506,123 | S | 6/2005 | English et al. | |
| 6,913,221 | B2 | 7/2005 | Moon et al. | |
| 7,017,603 | B1 * | 3/2006 | Rosine | B65H 75/403 137/342 |
| 7,073,529 | B1 * | 7/2006 | Harkey | B65H 75/4402 137/355.23 |
| D551,061 | S | 9/2007 | English et al. | |
| 7,377,289 | B1 | 5/2008 | English et al. | |

(Continued)

*Primary Examiner* — Kevin F Murphy
(74) *Attorney, Agent, or Firm* — Brooks Kushman P.C.

(57) ABSTRACT

A hose guide for a hose reel deck box is provided. More specifically, the hose guide is a one piece, or unitary body, component. The unitary body hose guide is structured to snap-fit to one or two travel bars that are part of the unitary body of the hose reel deck box housing assembly. The hose guide preferably includes two semi-enclosed passages that are structured to be slidably coupled to the travel bars.

18 Claims, 21 Drawing Sheets

(56) References Cited

U.S. PATENT DOCUMENTS

| | | | |
|---|---|---|---|
| 7,575,188 | B2 | 8/2009 | Mullen et al. |
| 2007/0144584 | A1 | 6/2007 | Hatcher et al. |

* cited by examiner

ONE-PIECE HOSE GUIDE FOR HOSE REEL DECK BOX

This application is a divisional application of U.S. application Ser. No. 13/309,590, filed Dec. 2, 2011, which issued as U.S. Pat. No. 9,796,558 B2 on Oct. 24, 2017, which is hereby incorporated by reference in its entirety.

BACKGROUND OF THE INVENTION

Field of the Invention

The present invention relates to hose reel deck box and, more specifically, to a hose reel deck box having a one-piece manual hose guide system.

Description of the Related Art

A hose reel deck box is a housing assembly supporting a hose reel. The hose reel includes a basket assembly having a barrel and a hand crank. The hose is wrapped about the barrel and the hand crank is coupled to the barrel. The crank may be coupled directly to the barrel or indirectly coupled via one or more gears. Both the crank and/or the barrel is/are, however, typically mounted on, and rotatably coupled to, the housing assembly. The hose may be full, or partially full, of water, or, empty as it is wound about the barrel. Regardless of the state of the hose, the weight of the hose creates torque on the housing assembly whenever the hose is wound up. Given a typical hose reel with generally square cross-section, the winding forces typically cause such a housing assembly to distort or "skew" into a non-rectangular parallelogram (diamond shape cross-section). The winding forces further apply stress in the area where the basket assembly is coupled to the housing assembly.

The housing assembly must be structured to resist the torque and other stresses applied thereto during the winding process. This may be accomplished by several known configurations. First, the housing assembly may be made from robust materials, typically metals. Such metal housing assemblies are expensive due to both material costs and assembly time. Second, plastic housing assemblies are typically less expensive than metal housings, but require extensive support structures, e.g. molded ribs (thin planar members) and braces, in order to resist the forces applied thereto. The forming of such support structures typically requires the sides of the housing assemblies to be formed separately and assembled. Moreover, as the sides are not identical, i.e. the sides that support the barrel are often mirror images, multiple molds are required. As such, the time and cost to produce and assemble a plastic housing is also more than is desirable. Third, the housing may be a combination of metal and plastic components, but these housing assemblies may include the disadvantages rather than the advantages of both materials.

The housing assembly must further provide for a number of functions or accomplish desired tasks. For example, the housing assembly must provide mountings for various components such as the barrel, the housing assembly must protect, and/or hide from view, the hose reel, and the housing assembly must be aesthetically pleasing to the user. The mountings for the barrel must resist local stresses caused by the winding forces noted above. This is typically accomplished by molding ribs and trusses, e.g. X-shaped ribs, into the sidewalls, especially along the edges of the sidewalls and/or a shaped mounting for the basket assembly into the plastic housing assembly sidewall. Such a mounting may rely upon its contoured shape to provide strength, and/or may include ribs or other support structures. Further, the hose reel deck box must be economical.

To reduce the cost of plastic housing assemblies, manufacturers have attempted to create housing assemblies consisting of as few pieces as possible. Cost reductions in the manufacturing process can be implemented by reducing the number of separate components and the time/effort required to assemble such various components. For example, it is typically less expensive to mold a mounting for a crank into a housing assembly sidewall than it is manufacture the mounting separately and couple it to the housing assembly sidewall. In theory, the assembly cost could be reduced to, essentially, zero if the housing assembly were a single molded piece. This reduction in cost must, however, be balanced against the cost of the mold and the manufacturing costs associated with complex molds, e.g. a higher failure rate. That is, complex shapes, such as a crank mounting, must be incorporated into the mold and must be constructed in such a way that the molds may be separated and the molded product may be separated from the molds. Further, the cavity in the mold used to create complex shapes may be difficult to fill with liquid plastic during the injection process resulting in the increased failure rate noted above.

Presently, it is known to mold a housing assembly wherein the four vertical sidewalls are a unitary piece. A top sidewall, and possibly a bottom sidewall, are added to complete the housing assembly enclosure. Alternately, the top sidewall may be included in the mold. That is, the sides, and possibly the top, of the housing assembly are molded as a "unitary housing." The sidewalls include mounts for the crank, the hose reel, and other components. Such features are formed as contoured surfaces of the sidewall. However, because the contoured surfaces that form the basket assembly mounting must be structured to come off the mold, i.e. tapered in a specific direction as described below, the design of the mountings are controlled more by the molding process than by a desire to design a mounting structured to reduce stress or aesthetics. Typically, very few additional components are added to the unitary housing.

While use of a unitary housing reduces the assembly time, the unitary housing is difficult to mold, especially in light of the fact that this housing must resist most of the winding forces. Further, such a unitary housing typically includes a number of molded support ribs and other contoured surfaces structured to resist the winding forces; but these features are difficult to incorporate into a mold. Typically, a mold is pulled apart over a single axis, e.g. a top mold must be lifted vertically off a lower mold. Thus, and again assuming the molds are separated vertically, it would be impossible to have a horizontally extending element, such as a plurality of horizontal ribs, as the mold that is moved could not pass the ribs. Thus, the unitary housing component may only have a number of vertically extending ribs or similar contoured surfaces. These features resist skewing of the unitary housing.

While use of a unitary housing reduces assembly costs, the creation of such molds is very expensive and the extensive contouring leads to many deformations in the molded parts. Further, the limited type of support ribs, e.g. no X-shaped trusses, means that a unitary housing is less capable of resisting winding stresses than a structure that does includes more robust ribs. Further, the contoured mounting for the basket assembly typically has a shape that is less than pleasing and may include only vertical ribs on its inner surface. Further, while weak basket assembly mountings may not cause an instant failure, repeated stress causes the unitary housing component to wear out more quickly. Further, the functional contoured surfaces are not smooth and tend to be asymmetric. Such contouring is, generally, not considered to be as aesthetically pleasing as symmetrical flat sidewalls.

As noted above, one advantage of using a unitary sidewall in the housing is that the assembly time and cost for the hose reel is reduced. But even such unitary sidewall hose reels require some assembly, especially if the hose reel includes an "autotrack" device. As is known, an autotrack device is part of a hose winding system. The system typically includes a guide rod having a bi-directional track groove disposed thereon, a retaining rod, and a follower. The guide rod is coupled to the basket assembly drive. Thus, when a user turns the crank to take up the hose, the guide rod also rotates. The follower is a housing enclosing a tooth, or other construct, structured to be disposed in the guide bar bi-directional track groove. The follower is further coupled to, and structured to slide over, the retaining rod. The guide rod extends generally parallel to, but spaced from, the basket assembly axis of rotation.

In this configuration, the follower moves laterally back-and-forth over the guide rod as the hose is wound. That is, as the guide rod rotates, the tooth engages the surface of the bi-directional track groove. The follower's further engagement with the retaining rod prevents the follower from rotating with the guide rod, i.e. the follower remains in a fixed orientation while the guide rod rotates. This engagement of the tooth during rotation of the guide rod while the follower remains in a fixed orientation causes the follower to move along the groove. Thus, a hose that passes through the follower will be moved back-and-forth while the hose is being wound about the basket assembly thereby winding the hose is a regular pattern and spreading the wound hose over substantially the entire length of the basket assembly.

The disadvantage of such an autotrack is that the guide rod must be disposed in a passage within the follower, and more specifically the body of the follower, so as to allow the tooth to be maintained in the groove. That is, the follower is disposed about the guide rod so as to maintain a proper spacing between the tooth and guide rod. If the follower body were disposed on only one side of the guide rod, the follower body would likely lift off the guide rod when the guide rod rotates. Thus, the guide rod must be trapped in a follower passage. Further, the tooth is typically spring biased into the groove. In order for the tooth to fully engage the groove and/or to provide a mounting for the spring, the follower is a hollow body that is, typically, assembled about the guide rod. Thus, the autotrack device requires assembly steps that are typically eliminated when using a unitary sidewall housing.

SUMMARY OF THE INVENTION

The disclosed and claimed concept relates to a hose guide for a hose reel deck box. More specifically, the hose guide is a one piece, or unitary body, component. The unitary body hose guide is structured to snap-fit to one or two travel bars that are part of the unitary body of the hose reel deck box housing assembly. The hose guide preferably includes two semi-enclosed passages that are structured to be slidably coupled to the travel bars.

DETAILED DESCRIPTION

Figure 1:
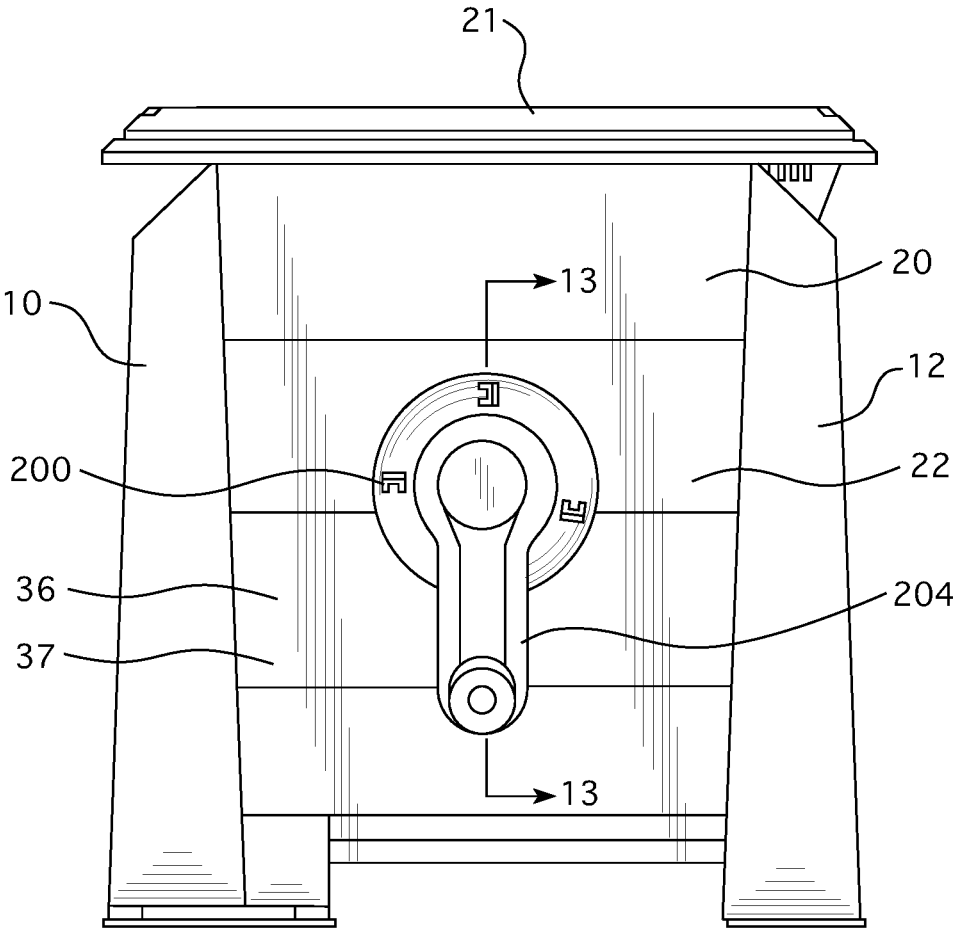
FIG. 1 is a side view of a hose reel deck box.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, "bracingly coupled" means that when two components are coupled, one component provides structural support or rigidity to the other component. Typically, to be bracingly coupled, one component must be coupled to another component at two or more spaced locations or have an elongated coupling.

As used herein, the word "unitary" means a component is created as a single piece or unit; that is, a component that includes pieces that are created separately and then coupled together as a unit is not a "unitary" component or body.

As used herein, a "unitary housing component" is a unitary component defining a partially enclosed space that is substantially open on at least one side but not more than two sides. For example, a generally square tube, wherein the four sides are formed from one piece, could be a "unitary housing component." A passage for an element such as, but not limited to, a basket assembly coupling is not a substantial opening. Further, a "unitary housing component" is capable of being skewed, as described above.

As used herein, "proximate" means "at" or "adjacent." Thus, if component A is directly coupled to component B "proximate" the upper edge of component B, the coupling may be at or adjacent the upper edge of component B.

As used herein, "snug," as in a "snug" engagement or two components fitting "snugly" together, means that two components engage each other in a tight but non-binding manner.

As used herein, "corresponding" means structured to fit together. For example, a bolt may fit within any nut having a larger diameter opening, but the bolt's threads only engage a nut of a corresponding size, i.e. a nut structured to fit the bolt.

As used herein, "generally planar" means a thin member or surface wherein any offset area of the member/surface is not offset more than about 1.0 inch from the plane of the member/surface.

As used herein, "substantially planar" means a thin member or planar surface wherein any offset area of the member/surface is not offset more than about 0.25 inch from the plane of the member/surface.

As used herein, a "snap-fit coupling" means a coupling that is, typically, temporary and wherein two coupling components, one of which is at least minimally flexible, are maintained in a coupled configuration due to a bias created by the minimally flexible component. For example, a passage in a minimally flexible, tubular body, wherein the passage has a longitudinal opening, may be temporarily widened allowing an object to pass into the passage. When the object is in the passage, the minimally flexible body returns the passage to the original configuration with the object disposed in the passage. As is known, the minimally flexible body typically closes about the object with a "snap" or "click" sound.

As used herein, "snap-fit," used as a verb, means to be coupled by a "snap-fit coupling."

Figure 2:
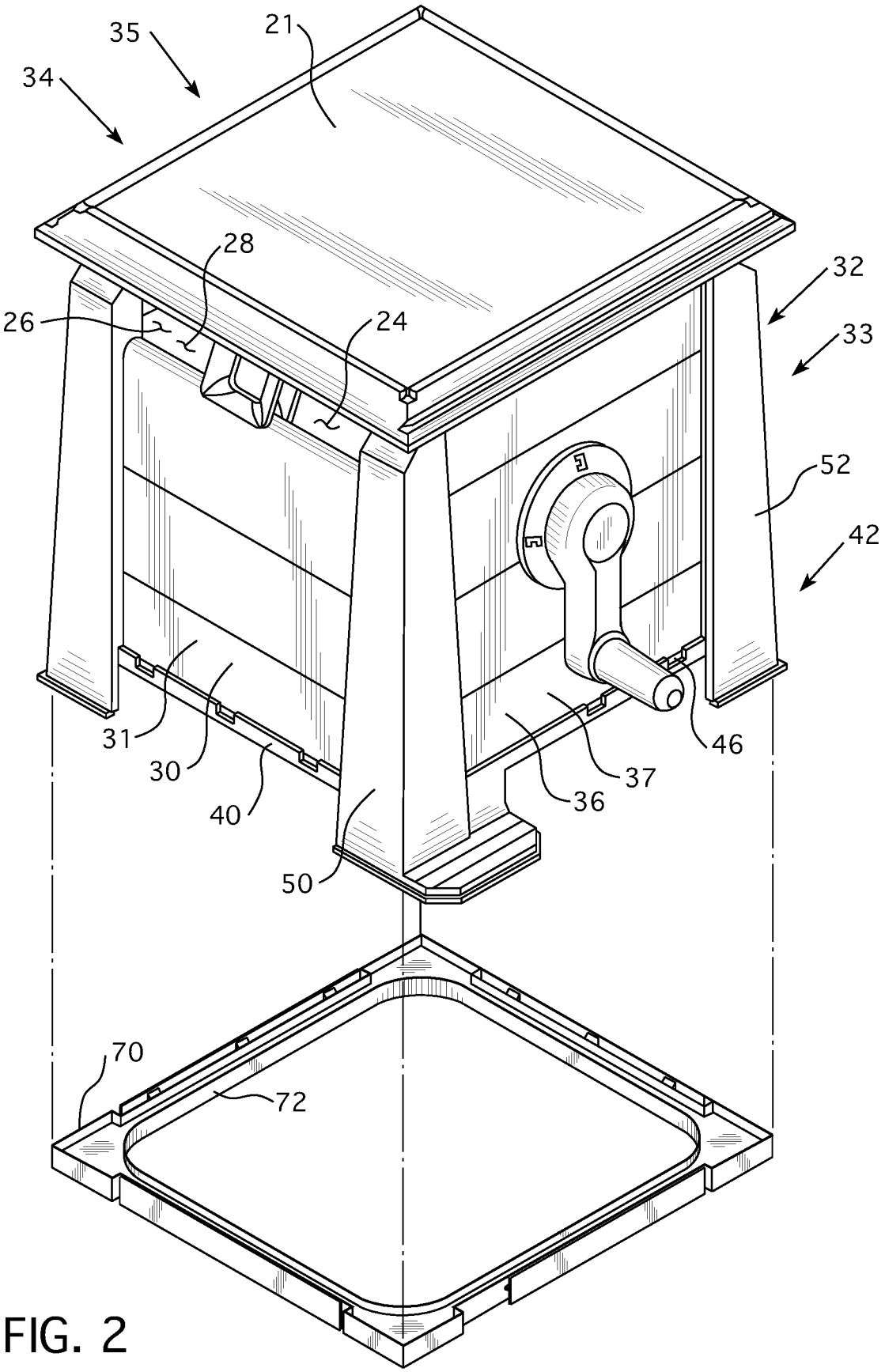
FIG. 2 is an isometric, exploded view of a hose reel deck box with a stiffener.
Figure 3:
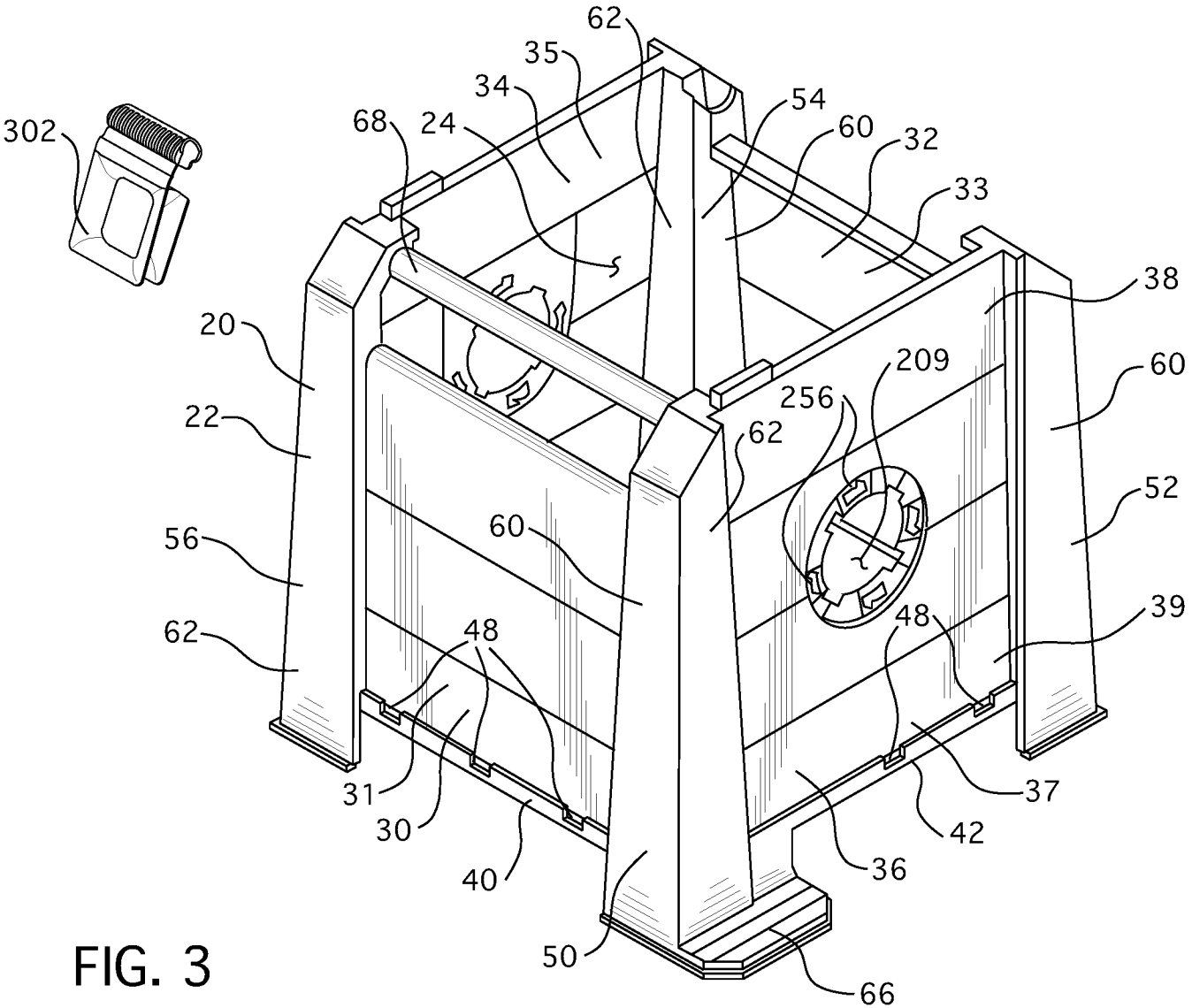
FIG. 3 is an isometric, exploded partial view of a hose reel deck box.
Figure 13:
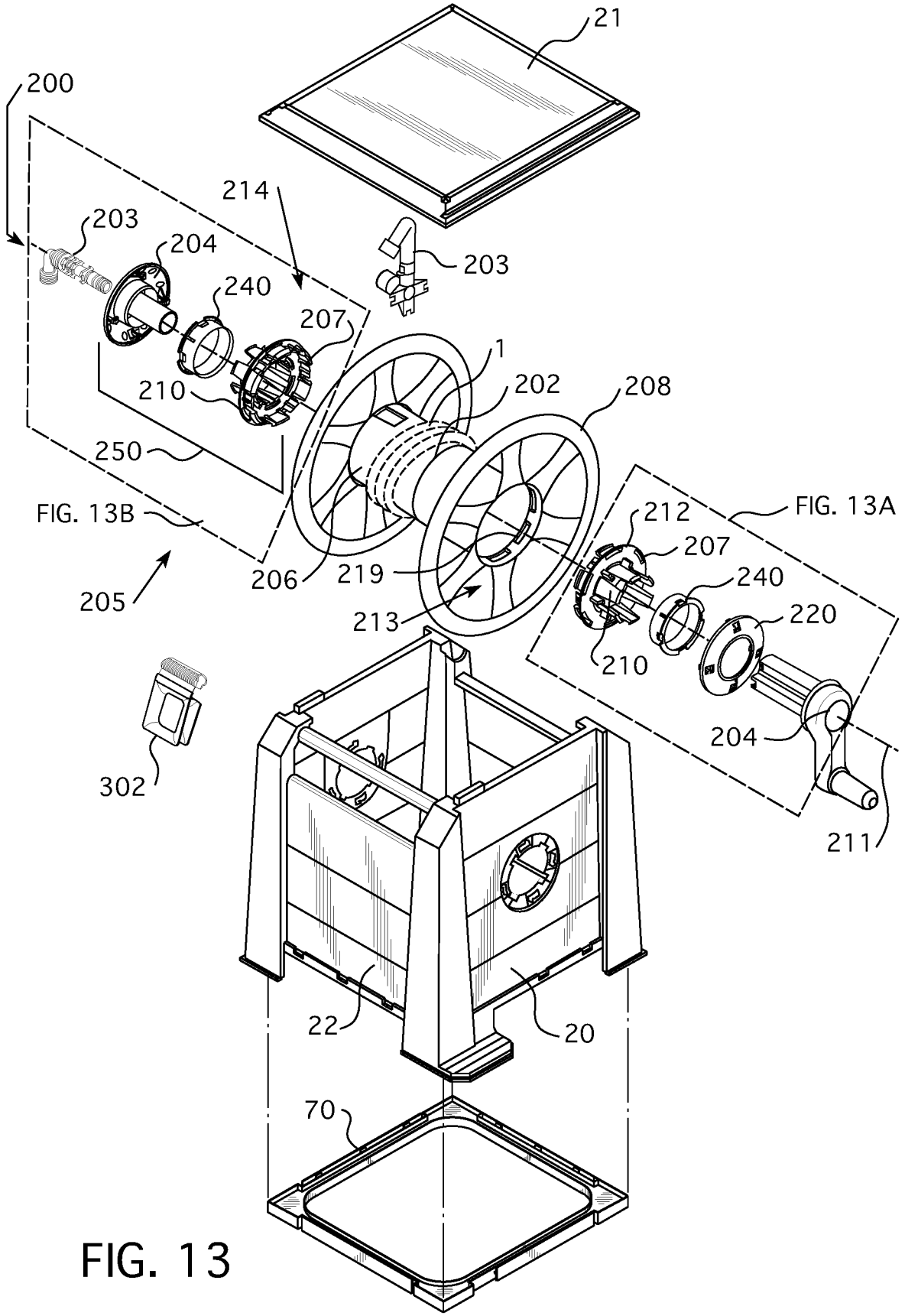
FIG. 13 is an exploded view of the basket assembly coupling assembly.

As shown in FIG. 1, a hose reel deck box 10, hereinafter "hose reel" 10, includes a housing assembly 12 and a basket assembly 200. As shown in FIG. 13, the basket assembly 200 is rotatably coupled to the housing assembly 12 as detailed below. As shown in FIGS. 2 and 3, the housing assembly 12 includes a unitary housing component 20, a top member 21, and a stiffener 70. As used herein, the "housing component" 20 is the element defining the generally vertical sidewalls of a hose reel deck box 10. Additional elements, e.g. the top member 21 or non-slip feet (not shown) are parts of the housing assembly 12 and are not part of the "housing component" 20. The unitary housing component 20 is in a first configuration, but is capable of being twisted into a skewed configuration. That is, the unitary housing component 20 is structured to be in a first, operational configuration wherein the basket assembly 200 may rotate freely, but, the torque and other stresses created by such rotation of the basket assembly 200 cause the unitary housing component 20 to skew whereby the basket assembly 200 may not rotate freely in the unitary housing component 20. The unitary housing component 20 has a unitary sidewall 22 defining an enclosed space 24 having at least one opening 26. The unitary sidewall 22 is, preferably, made from plastic and, more preferably, an injection molded plastic such as, but not limited to PP (Polypropylene) or PE (Polyethylene). As is known, injection molded plastic components are formed by injecting a liquid plastic into a mold comprised of two dies defining a cavity (none shown). The dies are brought together so as to define the cavity. Following injection of the plastic, the dies are separated by moving the dies, or one die, along a single axis. Thus, the components produced in this manner cannot have any non-tapered/non-axial structures. That is, the unitary sidewall 22 is comprised of generally planar members 31, 33, 35, 37 joined at corners, as described below, that are disposed in a generally vertical plane but are angled slightly inwardly from bottom to top. That is, as used herein, a "generally vertical" plane includes planes disposed at angles up to 5 degrees off vertical. Further, as used herein, "generally vertical upwardly tapered planes" means that two opposing planes, i.e. planes an equal distance from an intermediate plane, are "generally vertical" but are further angled towards each other while being farther apart at lower elevations and closer together at higher elevations.

The unitary sidewall 22 does not include any non-tapered/non-axial structures. That is, a "non-tapered/non-axial structure," hereinafter a "NTNA structure," as used herein, means any structure that, if incorporated into the unitary sidewall 22, would extend into the unitary sidewall enclosed space 24 in a non-axial manner, wherein the "axis" is the, typically, straight path over which the mold travels (or over which the unitary sidewall 22 travels when lifting the unitary sidewall 22 off a mold). Any structure that extends into the unitary sidewall enclosed space 24 in a non-axial manner, i.e. a manner aligned with the axis of separation, such as but not limited to, a rib, would prevent separation of the molded object from the lower die. That is, an axial structure, i.e. a structure extending in a plane that is aligned with, or parallel to, the axis, allows the upper die to move axially, upwardly away from the formed object, or, allows the formed object to be moved axially upwardly off the lower die, as the axial feature extends in a direction substantially similar to the direction the upper die/object moves during separation of the dies. Such an axial structure includes a vertically extending rib (not shown), whether on the inner or outer surface of the unitary body 22. Generally, any inwardly extending, non-axial surface violates the requirement that a molded object be tapered. That is, any inwardly extending, non-axial structure that is not tapered, i.e. having a larger cross-sectional area than the surface above, would prevent the upper die from moving axially, upwardly away from the formed object. Similarly, if any portion of the inner surface of the formed object has a smaller cross-sectional area than the lower mold, i.e. if the formed object included any inwardly extending NTNA elements, that NTNA element would prevent the formed object from being moved axially, upwardly off the lower die.

Thus, any NTNA structure is a structure that would interfere with the separation of the dies or the removal of the component from the dies. Accordingly, a component that is an NTNA structure cannot be a part of the unitary body 22 as the NTNA structure would prevent the separation of the dies or removal of the formed object from the lower die. For the purpose of this disclosure, it is assumed that the dies separate along a vertical axis. It is further assumed that the unitary sidewall 22 is used in the same orientation as it is formed. It is understood that the dies may separate along any axis and the unitary sidewall 22 may be used in any orientation. As such, directional adjectives, e.g., vertical, upper, lower, etc. are not limiting upon the claims. As the unitary sidewall 22 does not include any NTNA structures, it is understood that all structures described as part of the unitary sidewall 22 are either, or both, tapered structures or structures extending axially.

The unitary sidewall 22, preferably, has a generally square cross-sectional shape with four identifiable sidewalls; a front sidewall 30, a back sidewall 32, a right sidewall 34 and a left sidewall 36, that are portions of the unitary sidewall 22. The front sidewall 30 includes a horizontal opening, or has a smaller vertical height than the other sidewalls 32, 34, 36 thereby creating a housing assembly hose portal 28, which acts as a window through which a hose 1 may be passed and wrapped about the barrel 202 (described below). As is also known in the plastic arts, separation of the dies is easier if the dies do not slide across the molded component. As such, the unitary sidewall 22 also has a frusto-conical shape, i.e. the unitary sidewall 22 includes two pairs of generally vertical upwardly tapered planes that taper from bottom to top. This allows the upper die to rapidly disengage from the unitary sidewall 22 as the upper die moves upwardly. The unitary sidewall 22 may then be lifted off, and rapidly disengaged from, the lower die. As noted above, when using dies in this configuration, the unitary sidewall 22 cannot have any NTNA structures, e.g. horizontal ribs, as such structures would prevent die separation or removal of the unitary sidewall 22 from the dies.

Figure 4:
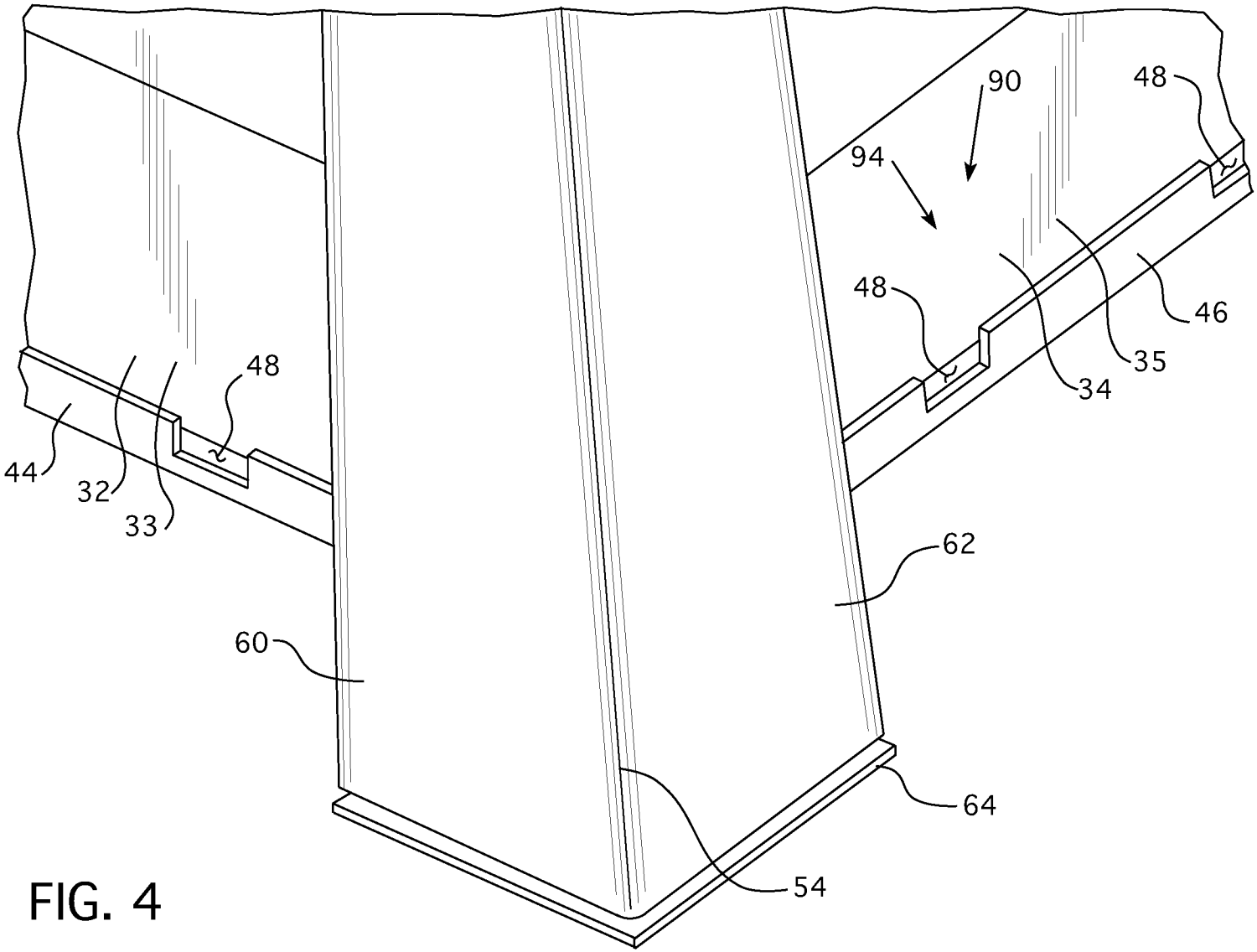
FIG. 4 is a detail isometric view of a hose reel deck box.

The sidewalls 30, 32, 34, 36 are generally planar, and preferably substantially planar, members 31, 33, 35, 37. Each sidewall 30, 32, 34, 36, i.e. each planar member 31, 33, 35, 37, has an upper side 38 and a lower side 39. Each sidewall member 31, 33, 35, 37 may include an outwardly offset rim 40, 42, 44, 46 disposed at the sidewall lower side 39. The offset rims 40, 42, 44, 46 have a slightly greater cross-sectional area than the sidewall members 31, 33, 35, 37. More preferably, the inner cross-sectional area of the rims 40, 42, 44, 46 is substantially the same as the outer cross-sectional area of the sidewall members 31, 33, 35, 37. Each rim 40, 42, 44, 46 is unitary with the associated sidewall member 31, 33, 35, 37. Further, each rim 40, 42, 44, 46 may include a plurality of openings 48, as shown in FIG. 4, at the interface of the rim 40, 42, 44, 46 and associated sidewall member 31, 33, 35, 37.

As shown best in FIG. 3, the sidewalls members 31, 33, 35, 37 may be coupled along their vertical edges (not shown), but preferably there is a corner formation 50, 52, 54, 56 between adjacent sidewalls members 31, 33, 35, 37. Each corner formation 50, 52, 54, 56 includes a first planar member 60 and a second planar member 62. Each of the corner formation planar members 60, 62 are portions of a sidewall 30, 32, 34, 36, i.e. the corner formations 50, 52, 54, 56 are unitary parts of the unitary sidewall 22. That is, for example, the front sidewall 30 has a corner formation first planar member 60 along its left vertical side, and, a corner formation second planar member 62 along its right vertical side with the first planar member 31 therebetween. The corner formation planar members 60, 62 are each coupled to a corner formation planar member 60, 62 from an adjacent sidewall 30, 32, 34, 36. That is, for example, the corner formation first planar member 60 of the front sidewall 30 is coupled to the corner formation second planar member 62 of the left sidewall 36. The corner formation planar members 60, 62 are disposed at a generally right angle to each other.

The corner formation planar members 60, 62 are outwardly offset from the associated sidewalls members 31, 33, 35, 37. Further, the corner formation planar members 60, 62 have a greater height than the associated sidewalls members 31, 33, 35, 37, with the additional length of the corner formation planar members 60, 62 extending below the associated sidewall lower side 39. In this configuration, the corner formations 50, 52, 54, 56 act as legs for the hose reel deck box 10. Further, the corner formation planar members 60, 62 may have a greater taper than the sidewalls 30, 32, 34, 36. That is, the corner formations 50, 52, 54, 56 may be flared at the bottom. Further, the bottom edges of each corner formation 50, 52, 54, 56 may include an outwardly extending flange 64 (FIG. 4). Further, one corner formation 50 may include an extended flange 66 (FIG. 3) that may be used as a foot pad during winding.

The unitary sidewall 22 may include additional features about the sidewall upper sides 38. As features at this location would not interfere with the separation of the molding dies, these features may extend inwardly into, or across, the enclosed space 24. These features include, but are not limited to a guide rod 68 (FIG. 3) reinforcing ribs, stiffening bars, and lifting handles.

As noted above, the sidewalls 30, 32, 34, 36 are, preferably, substantially planar members 31, 33, 35, 37. The planar members 31, 33, 35, 37 have a thickness of between about 0.08 inch and 0.15 inch, and more preferably about 0.1 inch. The corner formation planar members 60, 62 have a thickness of between about 0.08 inch and 0.15 inch, and more preferably about 0.1 inch. As used herein, a unitary sidewall 22 having such dimensions is a "thin" unitary sidewall 22. It is noted that a "thin" unitary sidewall 22 with such dimensions, typically, cannot include support ribs or other such structures as such structures typically require a greater thickness. Thus, a unitary sidewall 22 having ribs, or other such structures, is not a "thin" unitary sidewall 22. That is, a planar member having a rib is, typically, not a "generally" or "substantially" planar member as the rib typically extends more than an inch above the planar surface.

A thin unitary sidewall 22, preferably made from PP (Polypropylene) or PE (Polyethylene), i.e. a unitary sidewall 22 with the dimensions set forth above, is, generally, insufficiently robust to withstand the stress created by winding a hose 1 about a barrel 202 rotatably supported by the lateral sidewalls 34, 36. That is, as noted above, the torque and other stresses created by such rotation of the basket assembly 200 cause the unitary housing component 20 to skew whereby the basket assembly 200 may not rotate freely in the unitary housing component 20. The unitary sidewall 22 is made sufficiently robust by coupling the stiffener 70 thereto, i.e. the stiffener 70 is bracingly coupled to the unitary sidewall 22 and is structured to maintain the unitary housing component 20 in the a first, operational configuration. Moreover, the stiffener 70 is an NTNA structure.

The stiffener 70 is a body 72, preferably a unitary body, having a plurality of elongated, substantially rigid members 74 and may include a plurality of corner supports 76. The stiffener 70 is an NTNA structure relative to the unitary sidewall 22 in that the stiffener 70 includes surfaces that protrude inwardly in a non-axial manner, such as, but not limited to generally horizontal planar members, see e.g., the rigid members 74 and more specifically the rigid member bight 80 described below. The stiffener 70 may alternately include an outwardly extending feature having an inwardly extending lower surface. For example, if the stiffener 70 is shaped as a loop 78, the loop 78 includes an inwardly extending lower surface 79. If the stiffener 70 were incorporated into the unitary sidewall 22, the characteristics of the NTNA structure would prevent the removal of the unitary 22 from a mold. Thus, it cannot be said that the stiffener 70 is the same as a reinforcing structure incorporated into a unitary sidewall 22 as it would be impossible to have such an NTNA structure on a unitary sidewall 22.

Preferably, there is at least one stiffener member 74 for each sidewall 30, 32, 34, 36 of the unitary sidewall 22, and, one corner support 76 for each corner formation 50, 52, 54, 56. Thus, for the preferred embodiment having a four-sided housing assembly 12, there are four stiffener members 74 and four corner supports 76. The corner supports 76 are coupled to one or more of the rigid members 74. Each corner support 76 is disposed in a position corresponding to one housing assembly corner formation 50, 52, 54, 56. That is, regardless of the arrangement of the rigid members 74, as discussed below, each corner support 76 is disposed in a position corresponding to one housing assembly corner formation 50, 52, 54, 56. Further, each corner support 76 is structured to be coupled to the housing assembly planar members 31, 33, 35, 37 proximate each corner formation 50, 52, 54, 56.

The rigid members 74 are preferably arranged, i.e. disposed, in a shape generally corresponding to the housing assembly 12 perimeter. Thus, in the preferred embodiment wherein the housing assembly 12 perimeter is a generally square cross-sectional shape, the rigid members 74 are preferably disposed in a generally square loop 78 or parallelogram, hereinafter "loop" 78. The loop 78 formed by the rigid members 74 preferably has a cross-sectional area about the same as the unitary sidewall 22 proximate the lower side. Each rigid member 74, preferably, has a length substantially corresponding to the length of an associated housing assembly planar member 31, 33, 35, 37. That is, for example, if the housing assembly 12 were rectangular (not shown) having two twenty-inch long sides and two thirty-inch long sides, the plurality of rigid members 74 would include two members 74 about twenty inches long and two members 74 about thirty inches long. Each rigid member 74 is bracingly coupled to an associated housing assembly planar member 31, 33, 35, 37. The rigid members 74 may be coupled to the unitary sidewall 22 by a number of coupling devices 90 or configurations. The cross-sectional shape of the individual rigid members 74 is adapted to the various coupling devices 90, as discussed below.

Figure 5A:
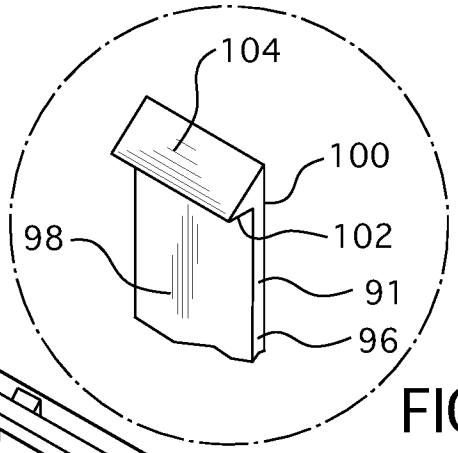
FIG. 5A is a detail view of a coupling component.

In the preferred embodiment, the loop 78 is sized to fit within the perimeter defined by the rims 40, 42, 44, 46. Alternately, the loop 78 may be sized to have substantially the same cross-sectional area as the rims 40, 42, 44, 46. As shown in FIG. 5A, the rigid members 74 have an upwardly facing W-shaped cross-section, or more preferably, a double H-shaped cross-section, i.e. similar to adjacent capital "H's" sharing a vertical member, which is, essentially, mirror image U-shaped members. The inner "H" acts to stiffen the loop 78 and, as set forth below, the outermost vertical member or tine acts as a cover 110. Thus, in cross-section, the rigid members 74 have at least a base or bight 80 and two upwardly extending tines 82, 84. Preferably, the W-shaped cross-section is a generally squared W-shape, i.e. formed of planar members coupled at generally right angles.

The stiffener body 72 is coupled to the unitary sidewall 22 by one or more coupling device(s) 90. The coupling devices 90 are, preferably, substantially similar, but a mixture of coupling devices 90 may be used. As the coupling devices 90 are preferably similar, a single coupling device 90 will be described; it is understood that a plurality of coupling devices 90 may be, and preferably are, used. The coupling device 90 has two components, a first component 92 and a second component 94. The coupling device first component 92 is disposed on the stiffener body 72, the coupling device second component 94 is disposed on the unitary sidewall 22 (FIG. 4).

In the preferred embodiment, the coupling device 90 includes a spring clip device 91 and the aforementioned openings 48 at the interface of the rim 40, 42, 44, 46 and associated sidewall member 31, 33, 35, 37. That is, the coupling device first component 92, a spring clip 91, includes an elongated, minimally flexible member 96 having a proximal end 98, a distal end 100, and a laterally extending latch surface 102. A tapered surface 104 extends from the latch surface 102 to the flexible member distal end 100. The flexible member proximal end 98 is coupled, and preferably directly coupled, to a rigid members 74 and extends upwardly therefrom. If the loop 78 is sized to fit within the perimeter defined by the rims 40, 42, 44, 46, the flexible member 96 is disposed outside the outer tine 82. If the loop 78 is sized to have substantially the same cross-sectional area as the rims 40, 42, 44, 46, the flexible member 96 is disposed on the bight 80. As noted, the coupling device second components 94 are the aforementioned openings 48 at the interface of the rim 40, 42, 44, 46 and associated sidewall member 31, 33, 35, 37. Each coupling device 90 is positioned on the stiffener body 72 so as to be aligned with coupling device second component 94, i.e. with an opening 48.

In this configuration, the stiffener body 72 is coupled to the unitary sidewall 22 by positioning the stiffener body below the unitary sidewall 22 and moving the stiffener body 72 upwardly. As the stiffener body 72 moves into the unitary sidewall enclosed space 24, each flexible member distal end 100 passes an associated coupling device second component 94, i.e. an opening 48. The flexible member 96 may flex outwardly slightly as the latch surface 102 moves toward the opening 48. Once the latch surface 102 moves to a position aligned with the opening 48, the flexible member 96 returns to a generally straight configuration thereby positioning the latch surface 102 within the opening 48 and coupling the stiffener body 72 to the unitary sidewall 22.

If the loop 78 is sized to have substantially the same cross-sectional area as the rims 40, 42, 44, 46, the rims 40, 42, 44, 46 are disposed in the groove defined by the rigid member 74 upwardly facing U-shaped cross-section. If the loop 78 is sized to fit within the perimeter defined by the rims 40, 42, 44, 46, the stiffener body 72 is disposed substantially, or entirely, within the unitary sidewall enclosed space 24. Further, if the loop 78 is sized to fit within the perimeter defined by the rims 40, 42, 44, 46, the stiffener body 72 may include an extra member, a cover 110, structured to overlay the coupling devices 90. The cover 110 is, essentially, the outer portion of the W-shaped body, or an L-shaped member disposed adjacent the outer tine 82 of the stiffener body 72. As the stiffener body 72 is moved into place, the cover 110 is disposed on the outer side of the unitary sidewall 22, i.e. the rims 40, 42, 44, 46 are disposed in the groove defined by the cover 110 upwardly facing U-shaped cross-section.

Figure 6:
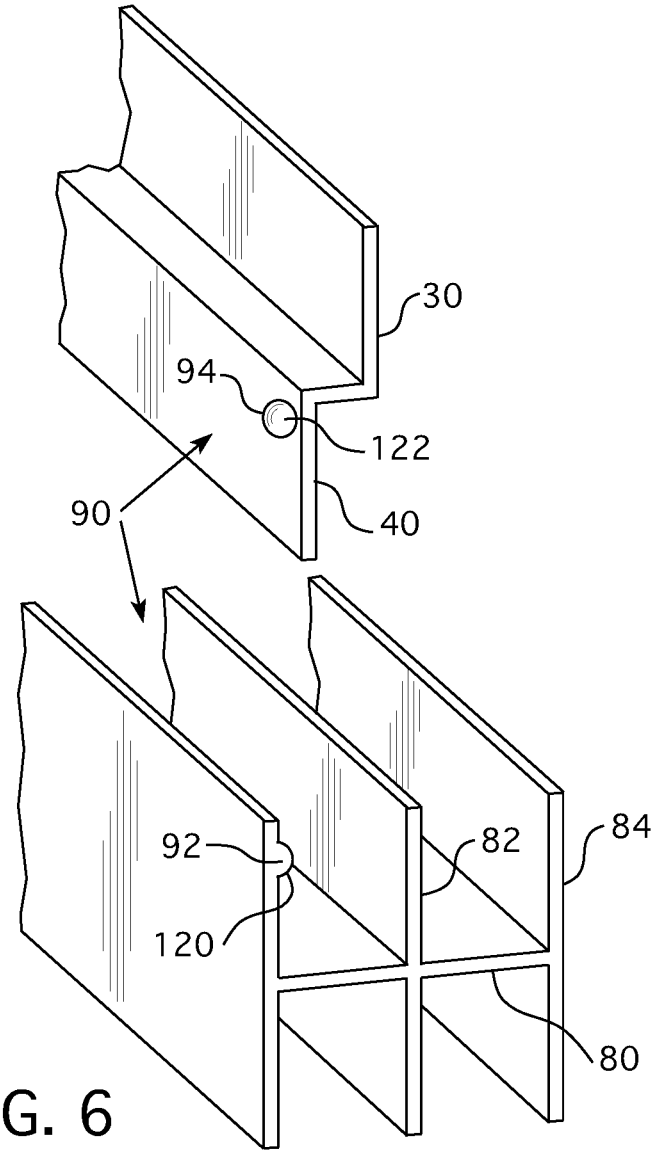
FIG. 6 is a detail view of another coupling component.
Figure 7:
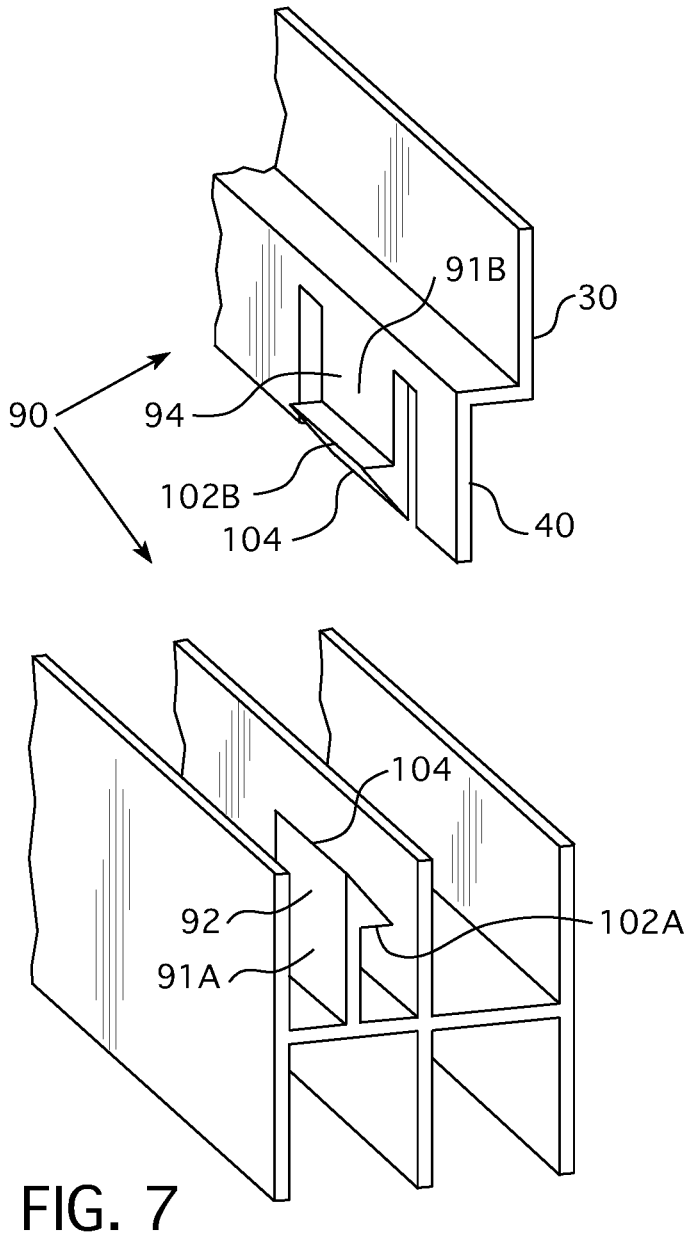
FIG. 7 is a detail view of another coupling component.

Coupling devices 90 having a distinct pair of components include, but are not limited to, a ball (which is actually a hemispherical bump) and detent, wherein the ball 120 is the first component 92 and is disposed on the outer surface of the stiffener body 72, and a detent 122 is the second component 94 disposed on the inner surface of the unitary body 22, as shown in FIG. 6. Another embodiment, FIG. 7, includes a pair of opposed spring clip devices 91. That is, instead of having a single spring clip 91, there may be two opposed spring clips 91A, 91B structured to have opposing latching surfaces 102A, 102B engage each other. It is noted that the spring clip device 91 and the ball 120 and detent 122 are reversible in that the location of the first and second components 92, 94 may be easily switched.

Figure 8:
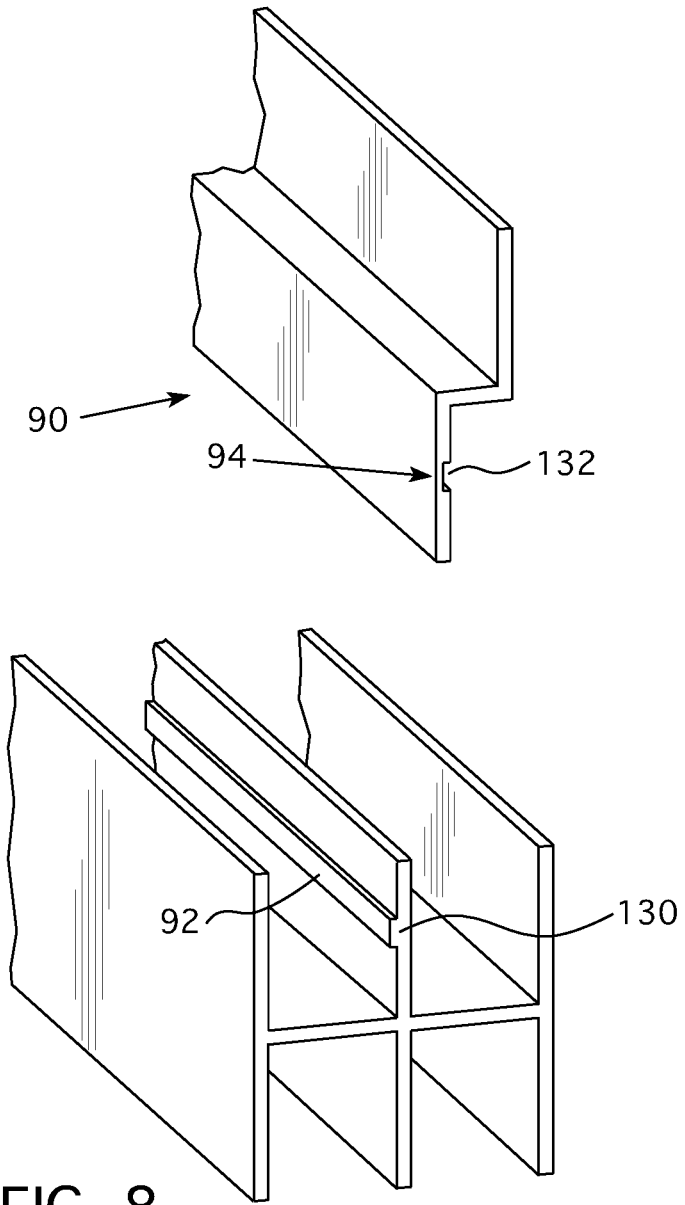
FIG. 8 is a detail view of another coupling component.
Figure 9:
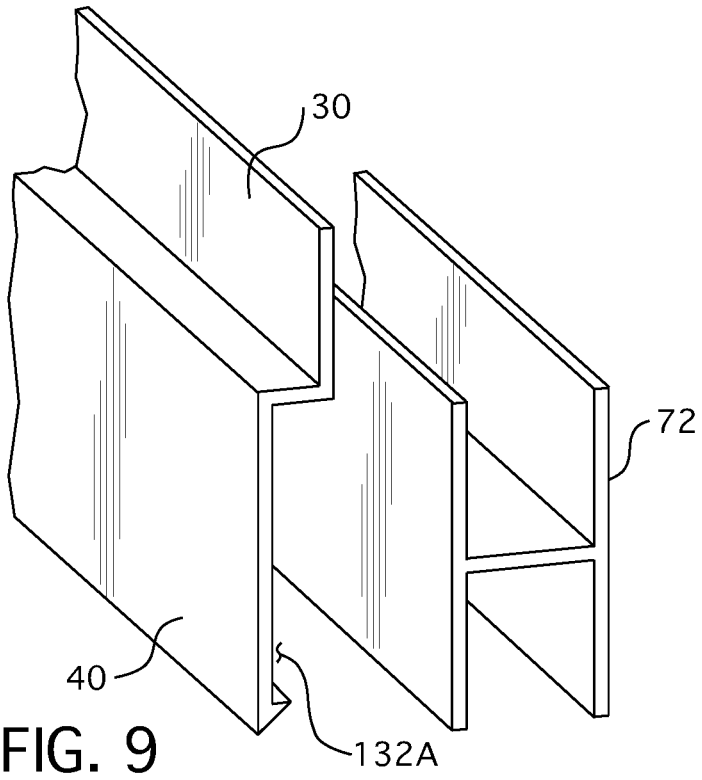
FIG. 9 is a detail view of another coupling component.
Figure 10:
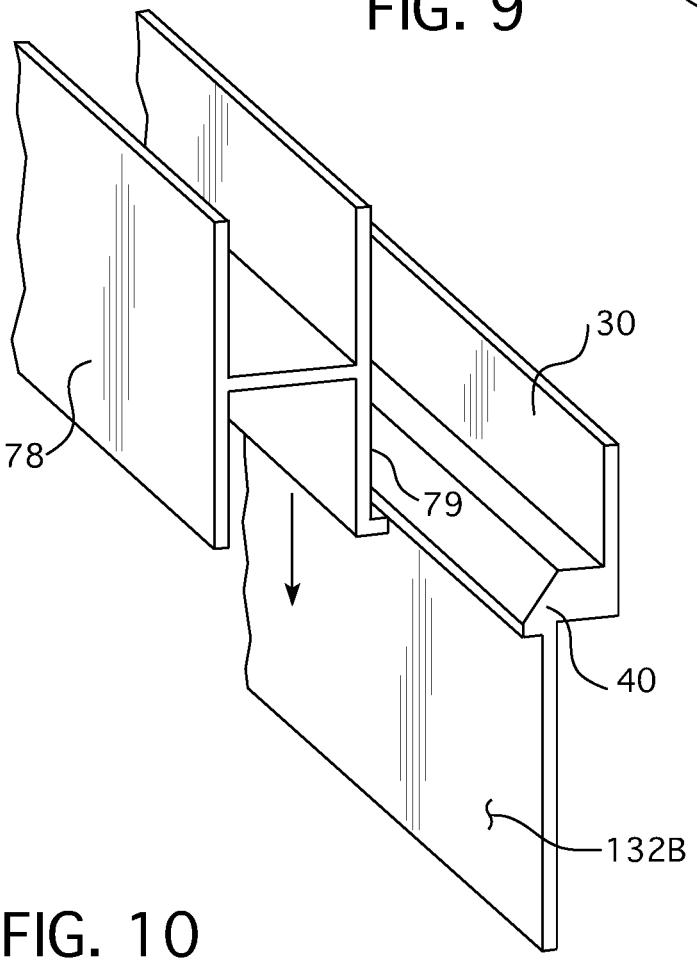
FIG. 10 is a detail view of another coupling component.

In another embodiment, FIG. 8, the coupling device 90 may be a tongue-and-groove configuration. The second component 94 is a groove 132 disposed on the inner surface of the unitary body 22. The tongue 130 may be a ridge extending from the outer surface of the stiffener body 72, similar to an extended "ball" in the ball 120 and detent 122 coupling device 90. Other coupling devices 90 may or may not include a distinct second component 94. That is, as shown in FIG. 9, the entire stiffener body 72 may act as the second component 94, i.e. a tongue 130, without having a distinct projection. In this embodiment, the stiffener body 72 acts as the second component 94 and is structured to fit into a groove 132A disposed on the inner surface of the unitary body 22. In another alternate embodiment, a groove 132B, as shown in FIG. 10, may be disposed on the outer surface of the of the unitary body 22 and the stiffener body 72, which in this embodiment has a cross-sectional area greater than most of the unitary body 22, and moved downwardly over the unitary body 22 into the groove 132B. That is, the groove is disposed near the lower side of the unitary body 22 and the stiffener body 72 is sized to fit snugly therein. In this embodiment, the stiffener body 72 includes a corner formation loop (not shown) sized to extend about, and snugly engage, each corner formation 50, 52, 54, 56.

Figure 5:
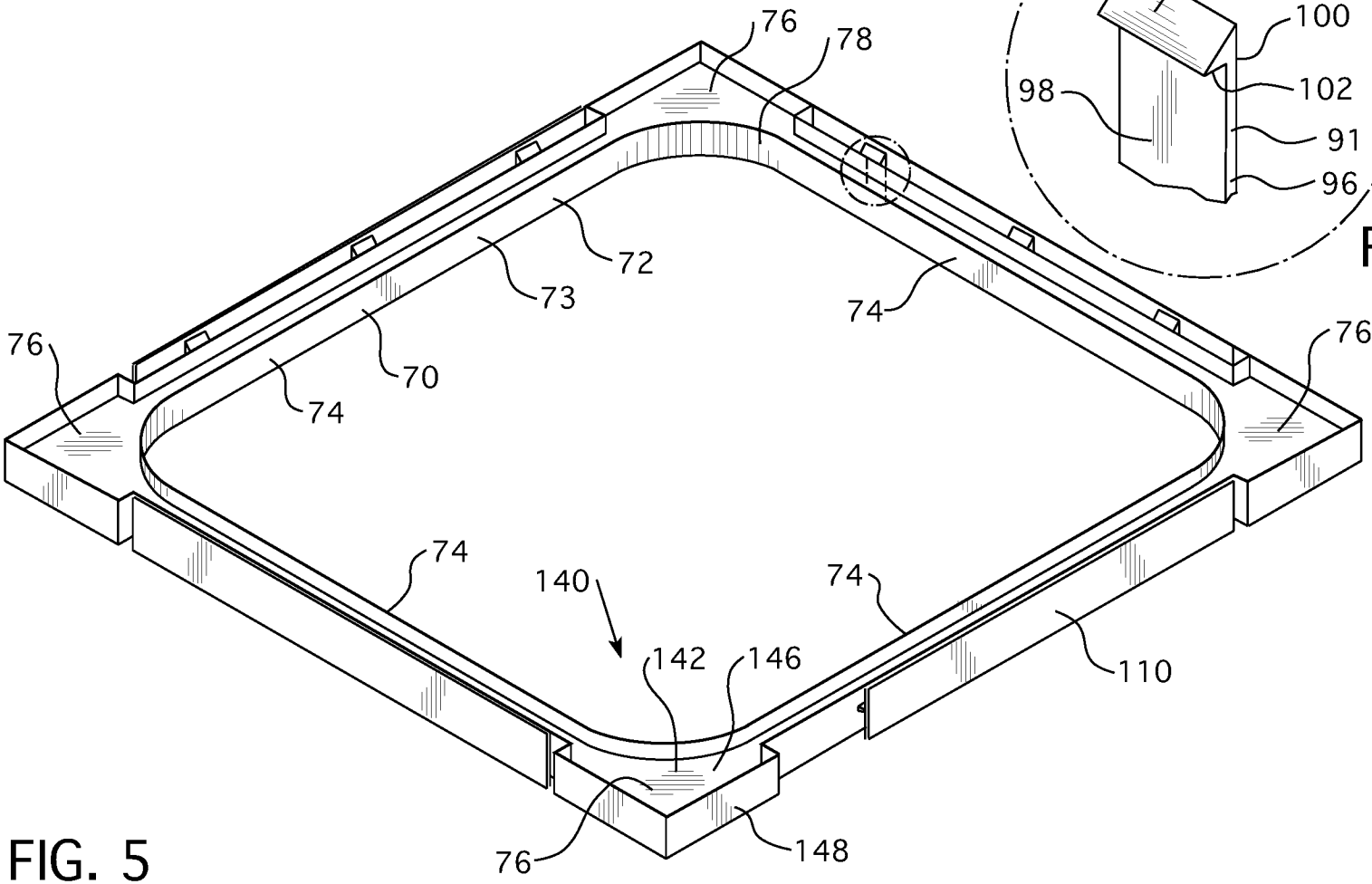
FIG. 5 is an isometric view of a stiffener.
Figure 5B:
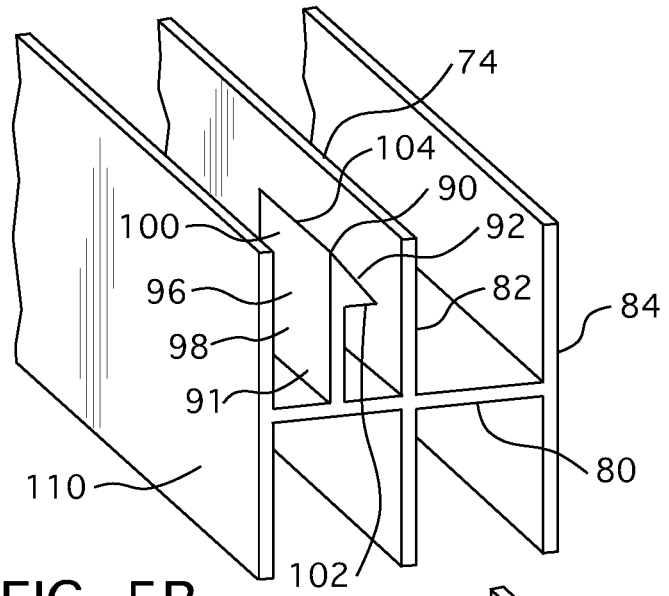
FIG. 5B is another detail view of a coupling component.
Figure 11:
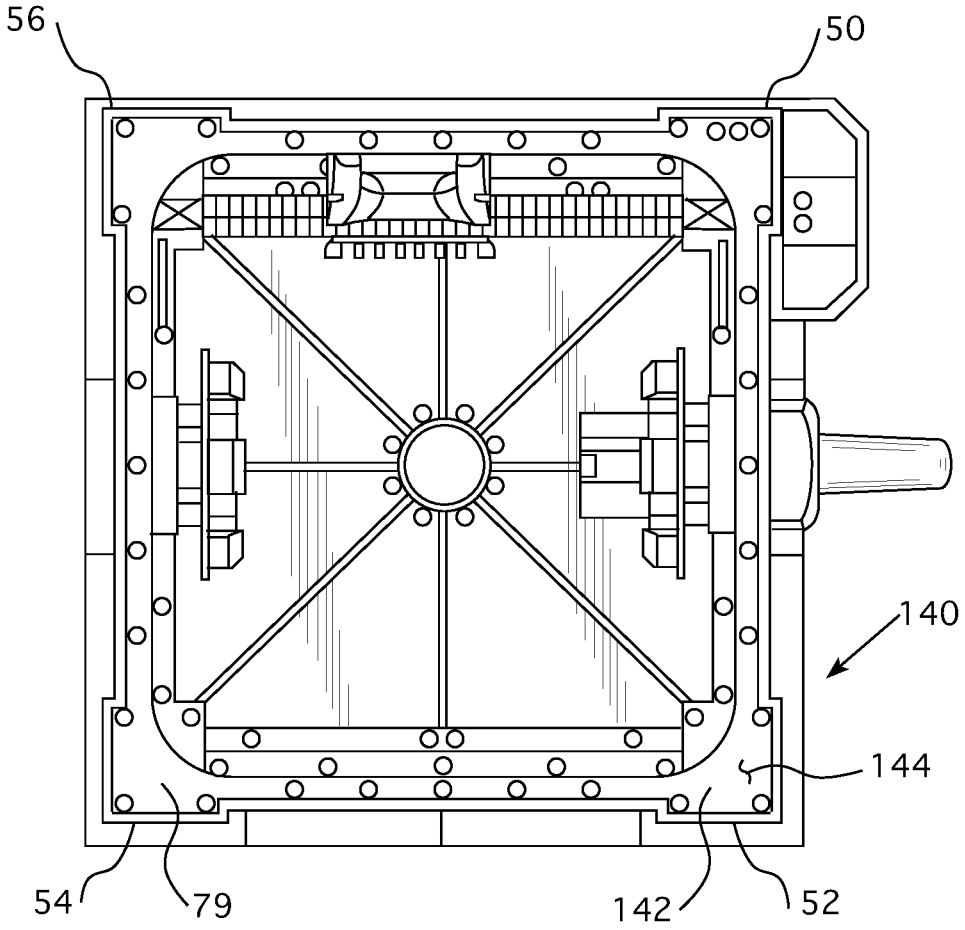
FIG. 11 is a bottom view of a hose reel deck box without a barrel.

When the stiffener body 72 is disposed within the unitary sidewall enclosed space 24, the stiffener body 72, i.e. the rigid members 74, may simply extend through each corner formation 50, 52, 54, 56. In the preferred embodiment, however, the stiffener body 72 includes a socketed coupling 140 at each corner formation 50, 52, 54, 56 as shown in FIGS. 5 and 11. That is, each corner formation 50, 52, 54, 56 is, essentially, a hollow two-sided tube disposed in a fixed relation to the other corner formations 50, 52, 54, 56. Because the corner formations 50, 52, 54, 56 cannot move a substantial distance relative to each other, the members of the two sided "tubes" may act as socket coupling second component 144. That is, a socketed coupling includes a first component 142, or "lug," and a second component 144, or "socket." The second socketed coupling component 144, the socket, defines a cavity and the first socketed coupling component 142 fits snugly therein. As each corner formation 50, 52, 54, 56 is, essentially a hollow tube, the stiffener body 72 may include a plurality of socketed coupling first components 142 disposed so as to fit within each corner formation 50, 52, 54, 56. That is, in the preferred embodiment having a generally square shape, each of the socketed coupling first components 142 is disposed at a corner of the loop 78. The socketed coupling first components 142 are each sized to fit snuggly within the associated corner formation 50, 52, 54, 56 at the elevation of the rims 40, 42, 44, 46. That is, as used herein, an "elevation" means at a specific height and in a generally horizontal plane relative to the deck box housing assembly 12.

In this embodiment, the socketed coupling first component 142, the lug, is a generally horizontal planar member 146 having a perimeter shaped to correspond to, i.e. to snugly engage, the interior surface of the associated corner formation 50, 52, 54, 56. Each socketed coupling first component planar member 146 may have a generally vertically extending peripheral rim 148 which is, essentially, a continuation of the stiffener body outer tine 82 and/or H-shaped cross-section.

Further, each socketed coupling 140 may include additional coupling devices 90 such as those described above. For example, each first component planar member 146 may also include a plurality of balls 120 disposed about the outer lateral side of the first component planar member 146. A corresponding plurality of detents 122 would be disposed about the inner side of each corner formation 50, 52, 54, 56.

As noted above, in the preferred embodiment, the stiffener body 72 has a U-shaped cross-section, or more preferably an H-shaped cross-section. These shapes allow for the preferred spring clip 91 coupling devices 90 to extend upwardly from the stiffener body 72. The stiffener body 72 may, however, have other cross-sectional shapes. For example, the stiffener body 72 may have a square cross-sectional shape which works well with the ball-and-detent coupling device 90. That is, the ball 120 is disposed on the outer surface of the square stiffener body 72. A triangular cross-section may work well with the tongue-and-groove coupling device 90. For example, a corner of a triangular stiffener body 72 may be the tongue 130. As such, the stiffener body 72 may have any cross-sectional shape suitable for the associated coupling device 90 thereon.

Figure 12:
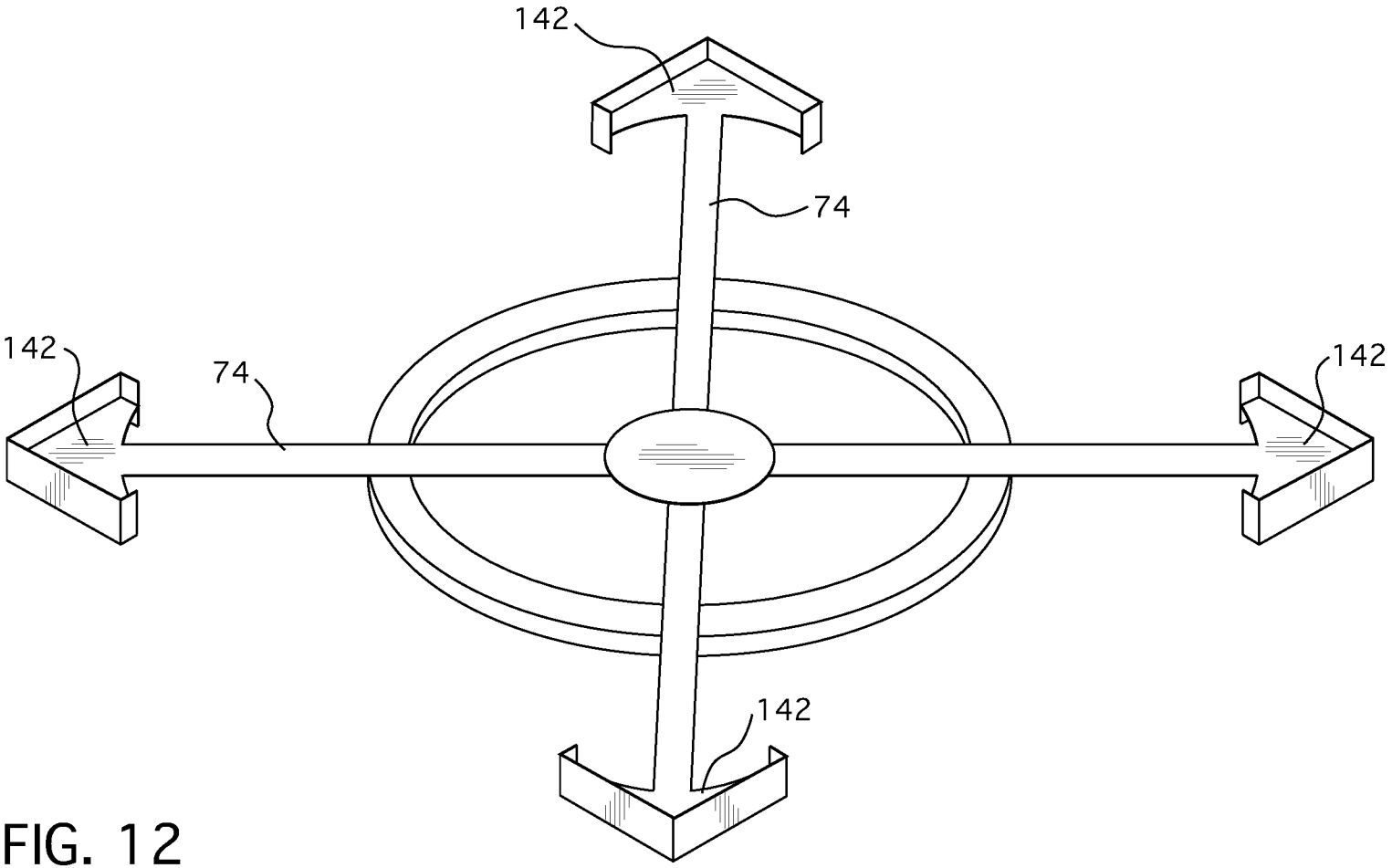
FIG. 12 is an isometric view of another stiffener.

In an alternate embodiment, the rigid members 74 are not arranged, i.e. disposed, in a shape generally corresponding to the housing assembly 12 perimeter. As shown in FIG. 12, the rigid members 74 may be disposed in an alternate pattern, such as, but not limited to, an X-formation wherein each tip of the X-shaped pattern is aligned with one corner formation 50, 52, 54, 56. In this embodiment, the rigid members 74 are not directly coupled to the unitary body 22. Instead, the rigid members 74 each have a socketed coupling component 142, 144 disposed at each tip of the X-shaped pattern. The socketed coupling first component 142 may be a lug and the corner formations 50, 52, 54, 56 form a corresponding socketed coupling second component 144, as described above. That is, each corner support 76 is disposed in a position corresponding to one housing assembly corner formation 50, 52, 54, 56, and each socketed coupling first component 142 is structured to be coupled to the housing assembly planar members 31, 33, 35, 37 proximate each corner formation 50, 52, 54, 56. The rigid members 74 in an X-formation may be supported by additional rigid members, e.g. a circular member as shown.

In another embodiment, partially described above and shown in FIG. 10, the stiffener body 72 is a loop 78 structured to be disposed about the outer perimeter of the unitary body 22 at a selected elevation. That is, the "selected elevation" is an elevation on the unitary sidewall 22 somewhere proximate or above the lower side. In this embodiment, the stiffener body 72 has a cross-sectional shape that is slightly larger than the cross-sectional shape of the unitary body 22 at the selected elevation at which the stiffener body 72 is to be disposed. That is, as noted above, the unitary body 22 is tapered toward the upper end. Thus, the stiffener body loop 78 may be brought downwardly over the smaller upper end of the unitary body 22 to an elevation wherein the stiffener body loop 78 engages the unitary body 22. Preferably, this elevation is below the elevation of the coupling between the barrel 202 (described below) and the unitary body 22. It is noted that the loop 78 has an inwardly extending generally horizontal, lower surface 79. That is, the lower surface 79 extends inwardly from the greatest cross-sectional area of the loop 78. In this configuration, the loop 78 is an NTNA structure relative to a unitary sidewall 22 in that, were the loop incorporated into the unitary sidewall 22, the loop lower surface 79 would extend into the unitary sidewall enclosed space 24. Further, any of the coupling devices 90 described above may be used to temporarily fix the loop 78 to the unitary sidewall 22.

In the preferred embodiment, there is a single stiffener 70 disposed proximate the lower end of the unitary body 22. The function of the stiffener 70, however, may be split among two or more stiffener bodies 72, such as, but not limited to, an upper stiffener (not shown) and a lower stiffener 70 as described above. That is, the stiffeners 70 are at different elevations. Further, the embodiments described above may be mixed together. For example, a lower stiffener 70 may be the same as the first embodiment described above, and, an upper stiffener may be an external loop 78 as described in the last embodiment above.

Figure 14:
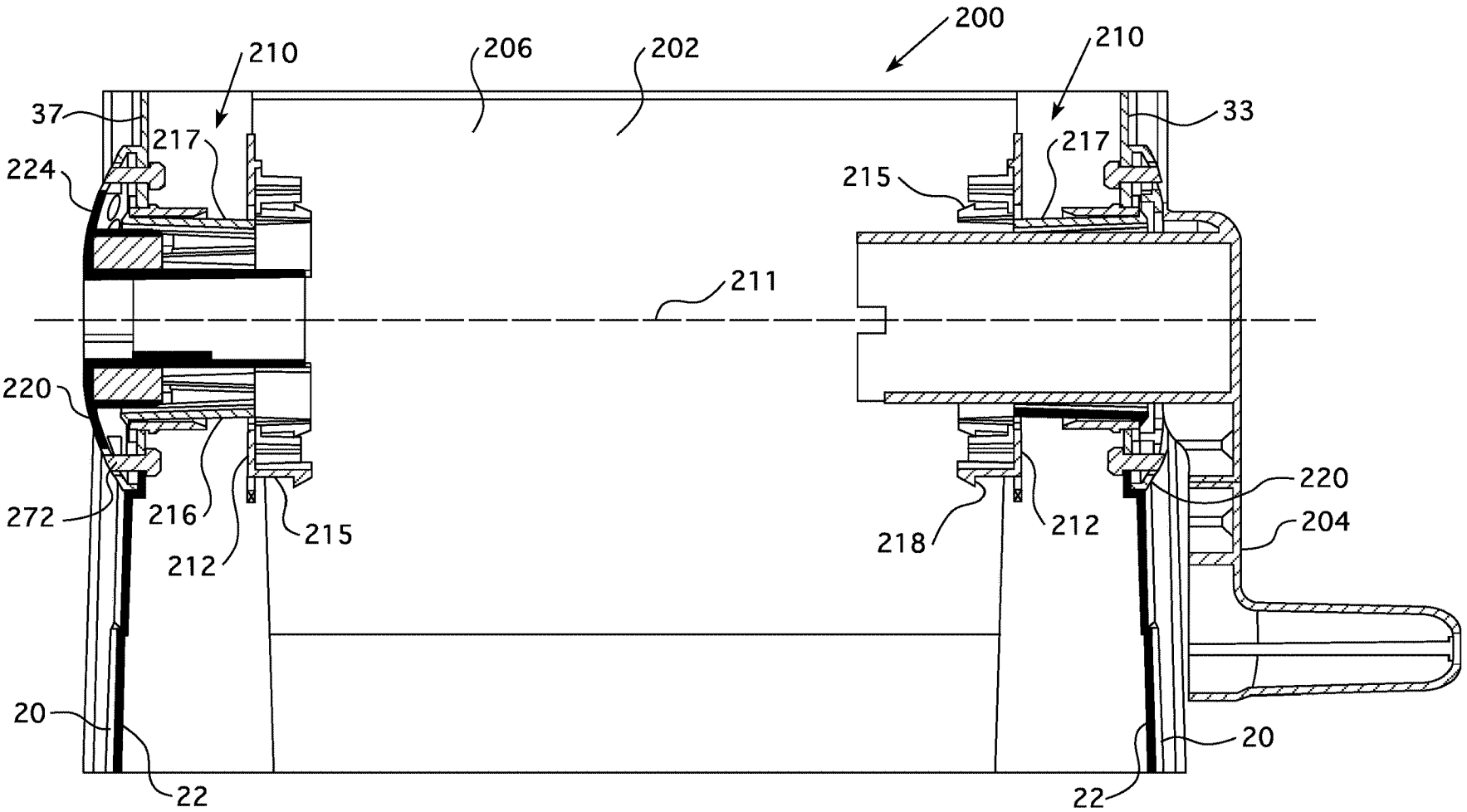
FIG. 14 is a cross-sectional view of a basket assembly.

In addition to providing the stiffener 70, the life of the hose reel deck box 10 may be extended by improving resistance to wear at the interface of the basket assembly 200 and the unitary housing component 20, shown in FIGS. 13 and 14. That is, the unitary sidewall 22 is relatively thin, as noted above. In such a thin wall, the stress of repeatedly winding a hose 1 onto the basket assembly 200 may cause the thin wall to wear out. The basket assembly coupling assembly 205 and, more specifically, the basket assembly coupling assembly coupling components 250, both discussed below, reduces the effects of such stresses.

As is known, a basket assembly 200 includes a barrel 202, a crank 204, a water delivery system 203 and a basket assembly coupling assembly 205. The barrel 202, typically, has a cylindrical body 206 about which a hose 1 (FIG. 13) is wound. The barrel 202 is structured to rotate about an axis of rotation. As such it is understood that any reference to "axis" or "axial" used in relation to the basket assembly 200 refers to the axis of rotation, and not the axis over which the unitary body 22 and associated molds, described above, move. The barrel body 206 may include two hubs 208, one proximate each axial end of the barrel body 206. The water delivery system 203 is structured to be coupled to, and in fluid communication with, a source of water. The water delivery system 203 includes a bifurcated conduit with a stationary end, which extends from the barrel body 206 axis of rotation, and a rotating end, which extends radially through the barrel body 206. A hose 1 is coupled to the water delivery system 203 rotating end and is wrapped about the barrel body 206. The crank 204 is coupled to the barrel body 206 and, as shown, may be fixed to the barrel body 206. As such, rotation of the crank 204 causes the barrel 202 to rotate. In operation, a user typically pulls on the hose 1 to draw the hose 1 from the hose reel deck box 10. That is, the crank 204 is not used to extend the hose 1. Conversely, the user utilizes the crank 204 to rotate the barrel body 206 when winding the hose 1.

The barrel body 206 is structured to be rotatably coupled to the unitary sidewall 22 via the basket assembly coupling assembly 205, as shown in FIG. 13. The basket assembly coupling assembly 205 includes both rotating elements coupled to the barrel body 206 and substantially stationary elements coupled to the unitary body 22. That is, the basket assembly coupling assembly 205 includes two basket end caps 210, which are in a fixed relationship with, and preferably directly coupled to, the barrel body 206 and/or hubs 208, and, two shroud members 220, that are fixed to the unitary sidewall 22. The shroud members 220 are structured to substantially cover and/or conceal elements located therebehind, i.e. elements located between the two shroud members 220. Further, the basket assembly coupling assembly 205, preferably, includes a bushing 240 disposed between each basket end cap 210 and the unitary sidewall 22. Each bushing 240 is also coupled to, and preferably directly coupled to, the unitary sidewall 22. The bushing 240 may be partially rotatable relative to the unitary sidewall 22. The shroud members 220 may be made from PP or PE, the basket end caps 210 may be made from POM, and the bushings 240 may be made from PP or PE. It is noted that a basket assembly coupling assembly 205 is disposed at opposing ends of the barrel body 206 and are coupled to opposing planar members 33, 37 on the unitary sidewall 22. For the purpose of this disclosure, the basket assembly coupling assemblies 205 are substantially similar. As such, only one basket assembly coupling assembly 205 will be described. It is understood that each basket assembly coupling assembly 205 is substantially similar to each other, with the exception in the shroud members 220 noted below. The basket assembly coupling assembly 205 is further structured to support the unitary sidewall 22 so as to reduce wear and tear. More specifically, the basket assembly coupling assembly 205 includes coupling components 250 that are structured to support the unitary sidewall 22.

Thus, the barrel body 206 is fixed to a basket end cap 210. The basket end caps 210 are also rotatably coupled to the unitary sidewall 22 thereby defining an axis of rotation 211. The axis of rotation 211 extends substantially horizontally. More specifically, the basket end caps 210 are rotatably coupled to two opposing planar members 33, 37 of the unitary sidewall 22. Accordingly, the two opposing planar members 33, 37 have a basket assembly mounting openings 209 (FIG. 3) therein. Further, the basket assembly mounting openings 209 may include a plurality of openings, as discussed below.

Each basket end cap 210 has a body 207 including a planar member 212, which is preferably a generally circular disk, a barrel coupling 213 and a rotatable coupling 214. The barrel coupling 213 and rotatable coupling 214 are both, preferably, a plurality of spring clips 215, 216, respectively, as well as the associated openings 219. Each barrel coupling and rotatable coupling spring clip 215, 216 has an axially extending body 217, i.e. extending generally parallel to the axis of rotation 211. Each barrel coupling and rotatable coupling spring clip body 217 is generally arcuate so that the plurality of barrel coupling and rotatable coupling spring clips 215, 216 each form a generally circular pattern. Each barrel coupling and rotatable coupling spring clip body 217 has a latch surface 218 extending generally perpendicular to the axis of rotation 211. The barrel coupling spring clips 215 are structured to extend through openings 219 (FIG. 13) on the barrel body 206 and/or hub 208. The rotatable coupling spring clips 216 are structured to be rotatably coupled to the basket assembly mounting opening 209 as described below. Moreover, the rotatable coupling spring clips 216 are structured to support the unitary sidewall 22 and, as such, are included as elements of the basket assembly coupling assembly coupling components 250, discussed below.

Figure 15:
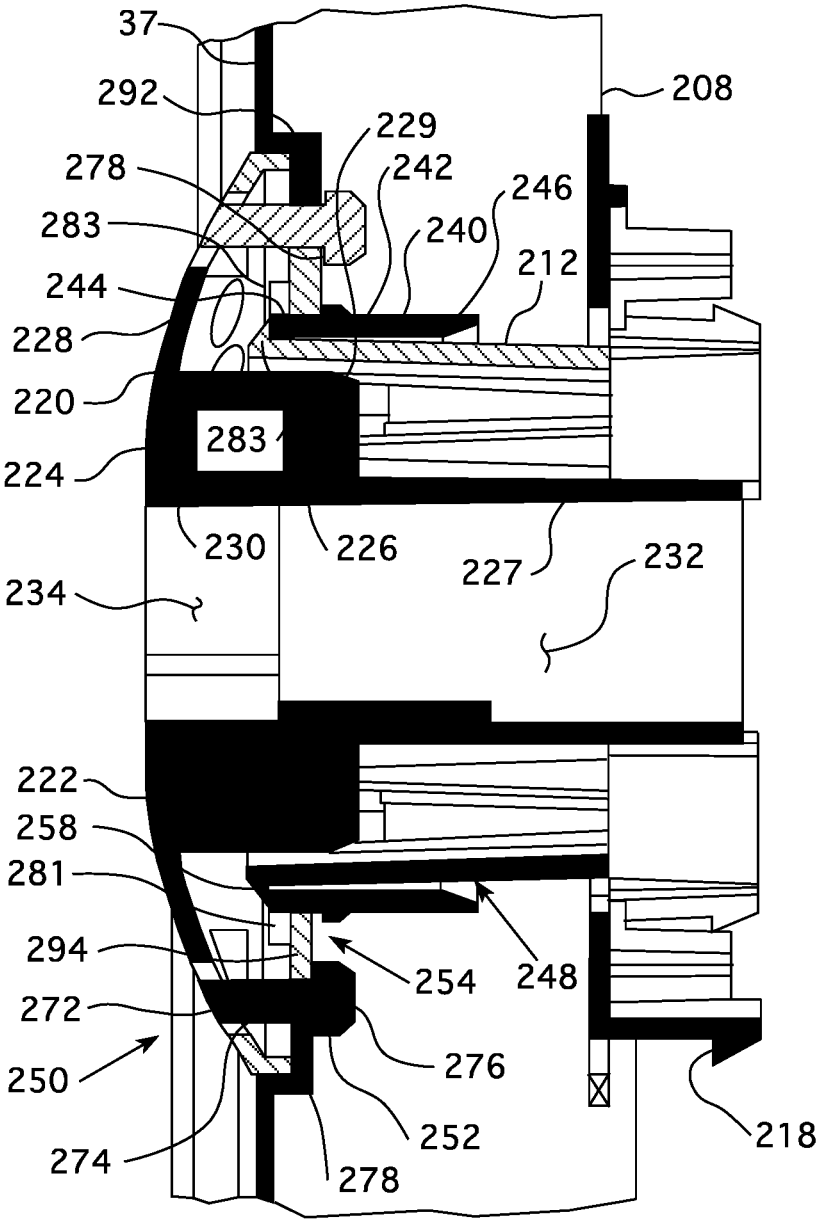
FIG. 15 is a cross-sectional view of a basket assembly coupling assembly.

The basket assembly shroud member 220 and a bushing 240 are shown in FIG. 15. The shroud member 220 has a body 222 with a generally planar outer portion 224 and an inner, annular extension 226. As shown, one shroud member body 222 may include a tubular extension 227. The shroud member 220 has several purposes including providing a decorative cover over the basket assembly mounting opening 209. As such, the shroud member 220 may have any shape and decorative features. As shown, the generally planar outer portion 224 is substantially circular and has an arcuate outer surface or outer face 228 and an inner side 230. Typically, only the shroud outer face 228 will be visible to the user. The inner annular extension 226 extends from the outer portion inner side 230 inwardly. That is, in reference to any part of the basket assembly 200, "inwardly" means generally toward the center of the barrel 202. The inner annular extension 226 has an outer surface 229 structured to engage the rotatable coupling spring clips 216, as described below. The shroud member 220 is coupled to, and preferably fixed to, the unitary sidewall 22 by the shroud first coupling components 252, discussed below. The shroud first coupling components 252 are structured to support the unitary sidewall 22 and, as such, are included as elements of the basket assembly coupling assembly coupling components 250, discussed below.

The shrouds 220 allow other components to pass therethrough if needed. Thus, the tubular extension 227 defines a water conduit passage 232. That is, the tubular extension 227 is hollow and the shroud outer portion 224 has a central opening 234. As described above, on one side of the barrel 202 the water delivery system 203 stationary end extends from the hose reel deck box 10 at the axis of rotation, i.e. through the shroud outer portion central opening 234. The opposing shroud member 220 may not include the tubular extension 227. Instead, the opposing shroud outer portion central opening 234 is, preferably, used as a passage whereby the crank 204 is coupled to the barrel body 206. That is, the crank includes a shaft that has a non-circular cross-section. This shaft is structured, i.e. shaped, to engage the basket end cap body inwardly extending axial ribs 296, described below, thereby providing a fixed coupling between the crank 204 and the barrel 202. If the crank 204 is offset from the barrel 202 and coupled thereto by gears or a chain drive (neither shown), the shroud outer portion 224 opposing the water delivery system stationary end may omit the shroud outer portion central opening 234. It is noted that neither the water delivery system 203 nor the crank 202 must engage the shrouds 220. That is, the water delivery system 203 and the crank 202 simply pass through associated shroud 220.

The bushing 240 has a hollow, substantially cylindrical body 242 with an outer axial end 244 and an inner axial end 246. The bushing body outer axial end 244 includes elements of the bushing first coupling component 254. The bushing first coupling component 254 is structured to support the unitary sidewall 22 and, as such, is included as elements of the basket assembly coupling assembly coupling components 250, discussed below. The bushing 240 is disposed about, and spaced from, the shroud inner extension 226 thereby defining a partially enclosed space 248. The rotatable coupling spring clips 216 are disposed in each partially enclosed space 248. That is, the rotatable coupling spring clips 216 are sandwiched between the shroud inner extension 226. In this configuration, no rotating portion of the basket assembly 200 directly contacts the unitary sidewall 22. As such, wear and tear on the unitary sidewall 22 due to friction with the rotating portions of the basket assembly 200 is, essentially, eliminated.

The interaction between the rotating portions of the basket assembly 200 and the unitary sidewall 22 does, however, cause stress on the unitary sidewall 22. The effects of this stress is reduced by the basket assembly coupling assembly coupling components 250. The basket assembly coupling assembly coupling components 250 include at least one shroud first coupling component 252, at least one bushing first coupling component 254, at least one basket end cap first coupling component 258 and at least one housing assembly second coupling component 256. As before, the first coupling components 252, 254, 258 are, generally, elements that extend through the second coupling components 256, which are openings in the unitary sidewall 22, as shown in FIG. 3 and in detailed in FIG. 15.

Figure 16:
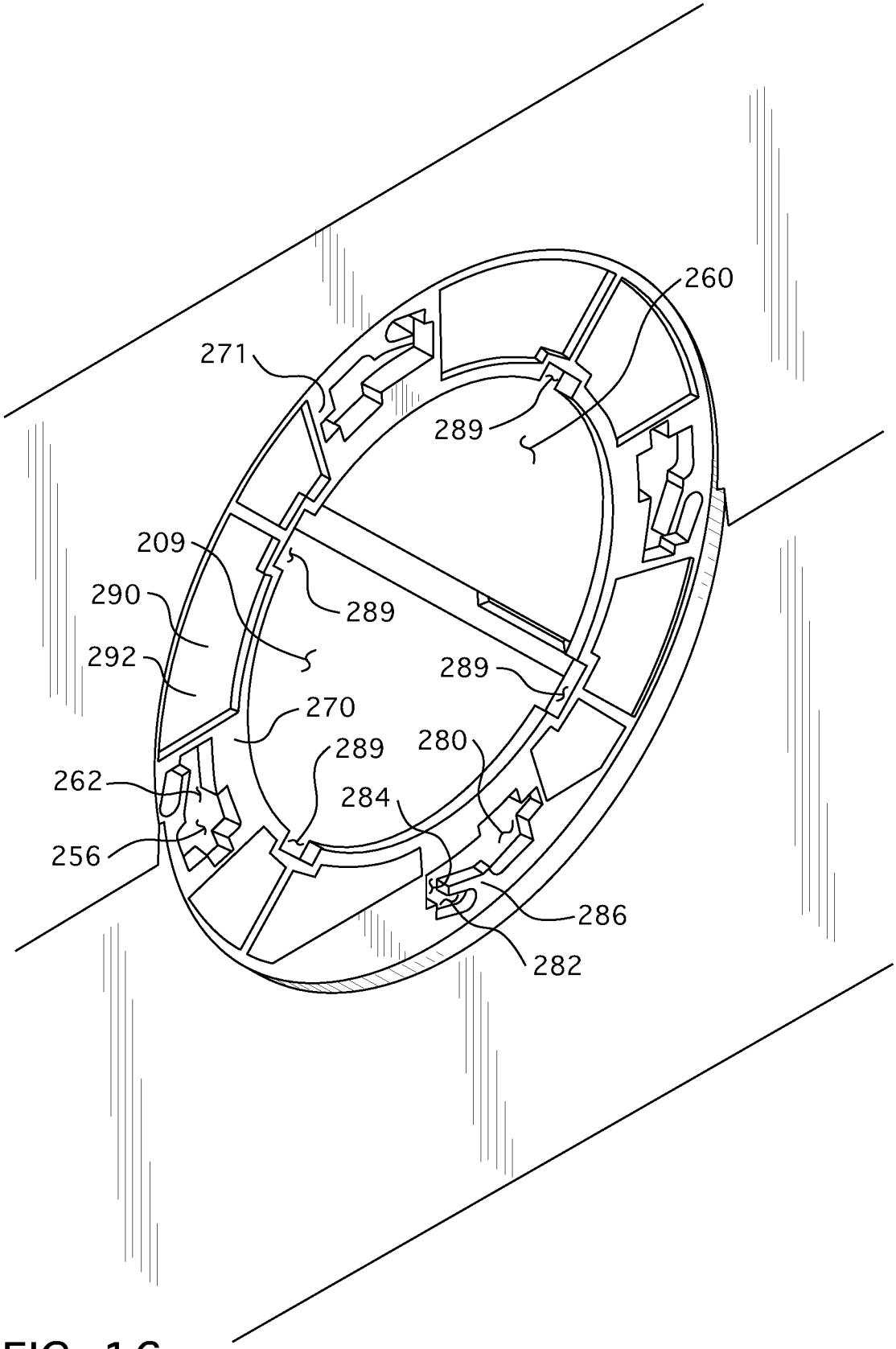
FIG. 16 is an isometric detail view of a basket assembly coupling assembly component.

That is, the at least one housing assembly second coupling component 256 includes the basket assembly mounting opening 209, alternatively identified as the housing assembly central opening 260, see FIG. 16. The housing assembly central opening 260 is, preferably, generally circular. Further, as described below, there are a plurality of shroud first coupling components 252, each of which must have a second coupling component to be coupled to. That is, there is also at least one shroud coupling opening 262, and preferably a plurality of shroud coupling openings 262. The shroud coupling openings 262 are disposed about the housing assembly central opening 260. In this configuration, there is a portion of the unitary sidewall 22 extending about the housing assembly central opening 260 and each shroud coupling opening 262. This area of the unitary sidewall 22 is the central opening web 271. The portion of the web 271 between the openings 260, 262 is the intermediate web 270. The intermediate web(s) 270 are a portion of the unitary sidewall 22 exposed to concentrated stress when the basket assembly 200 is rotated. Thus, the intermediate web(s) 270 are a portion of the unitary sidewall 22 that benefit from additional support, as set forth below.

Each shroud coupling opening 262 is shaped to secure the associated shroud first coupling component 252 therein. That is, each shroud coupling opening 262 defines a wide portion 280, a latch relief passage 282 and a seat 284. Between the shroud coupling opening wide portion 280 and the shroud coupling opening seat 284 is a flexible latching member 286. The flexible latching member 286 is an elongated, finger-like member that extends the side of the wide portion 280 and the latch relief passage 282. That is, the wide portion 280 and the latch relief passage 282 are disposed adjacent to each other with the flexible latching member 286 extending therebetween. If the flexible latching member 286 is biased in a first direction away from the wide portion 280, the flexible latching member 286 is flexed into latch relief passage 282. Between the wide portion 280 and the latch relief passage 282 is the seat 284. Details regarding the functions of the various portions and components of the shroud coupling opening 262 are set forth below.

As noted above, additional support to the intermediate web(s) 270 is beneficial. Such support is provided by the first coupling components 252, 254. For example, and as shown in FIG. 14, the at least one shroud first coupling component 252 has a body 272 that extends inwardly, i.e. toward the unitary body 22 and the barrel 202, from the shroud member body 222. The shroud first coupling component body 272 includes an elongated stem 274 and a head 276. The shroud first coupling component head 276 includes a support surface 278 that extends generally perpendicularly to the axis of the shroud first coupling component stem 274. That is, the support surface 278 extends in a plane substantially parallel to the plane of one of planar members 33, 37. The shroud first coupling component head support surface 278 is structured to engage the adjacent intermediate web 270 when installed.

The shroud first coupling components 252 and the shroud coupling openings 262 may be disposed in a symmetrical pattern about the center of the housing assembly second coupling component central opening 260. That is, if the shroud member body 222 were to be rotated about the rotational axis of the basket assembly 200, the shroud first coupling components 252 would always become aligned with a shroud coupling opening 262 at the same time. Thus, the shroud member body 222 may be coupled to the unitary sidewall 22 in any orientation. As discussed below, the shroud coupling openings 262 may be disposed in an asymmetrical pattern about the center of the housing assembly second coupling component central opening 260. In such a configuration, the shroud member body 222 may be coupled to the unitary sidewall 22 in a specific orientation. That is, the asymmetrical pattern of shroud first coupling components 252 act as a key to ensure the shroud member body 222 is coupled to the unitary sidewall 22 in a single orientation.

The shroud first coupling component head 276 has a greater cross-sectional area than the shroud first coupling component stem 274. The shroud coupling opening wide portion 280 is sized to allow the first coupling component head 274 to pass axially, i.e. generally parallel to the axis of rotation 211, therethrough. The seat 284, has a smaller cross-sectional area than the shroud first coupling component head 276. Thus, the shroud first coupling component head 276 cannot pass axially therethrough. As the first coupling component stem 274 is moved from the shroud coupling opening wide portion 280 toward the seat 284, the width of the first coupling component stem 274 causes the flexible latching member 286 to flex into the latch relief passage 282, thereby temporarily widening the shroud coupling opening 262 adjacent the seat 284. When the shroud first coupling component stem 274 moves past the flexible latching member 286, the flexible latching member 286 returns to its original position and the shroud first coupling component stem 274 is disposed in the shroud coupling opening seat 284 with the flexible latching member 286 immediately adjacent. The shroud coupling opening seat 284 is sized to snugly engage the shroud first coupling component stem 274. Moreover, the shroud first coupling component stem 274 may not move backwards into the shroud coupling opening wide portion 280 due to the flexible latching member 286.

Thus, during installation of the shroud member body 222, each shroud first coupling component head 276 is passed axially, i.e. in a direction generally parallel to the basket assembly 200 axis of rotation 211, through an associated shroud coupling opening wide portion 280. The shroud member body 222 is then rotated so that each shroud first coupling component stem 274 moves past the flexible latching member 286, until each shroud first coupling component stem 274 is disposed in a shroud coupling opening seat 284. Moreover, each shroud first coupling component stem 274 is trapped in a seat 284 by an associated flexible latching member 286.

Because each shroud first coupling component head 276 is wider than the size of the shroud coupling opening 262 at the shroud coupling opening seat 284, the shroud first coupling component head 276 extends over the portion of the unitary sidewall 22 immediately adjacent the shroud coupling opening seat 284. This area includes each intermediate web 270. That is, each intermediate web 270 is the portion of the unitary sidewall 22 between a shroud coupling opening seat 284 and the central opening 260. As each shroud first coupling component head 276 extends over the adjacent intermediate web 270, each shroud first coupling component support surface 278 engages and supports the adjacent intermediate web 270 when installed.

Figure 13A:
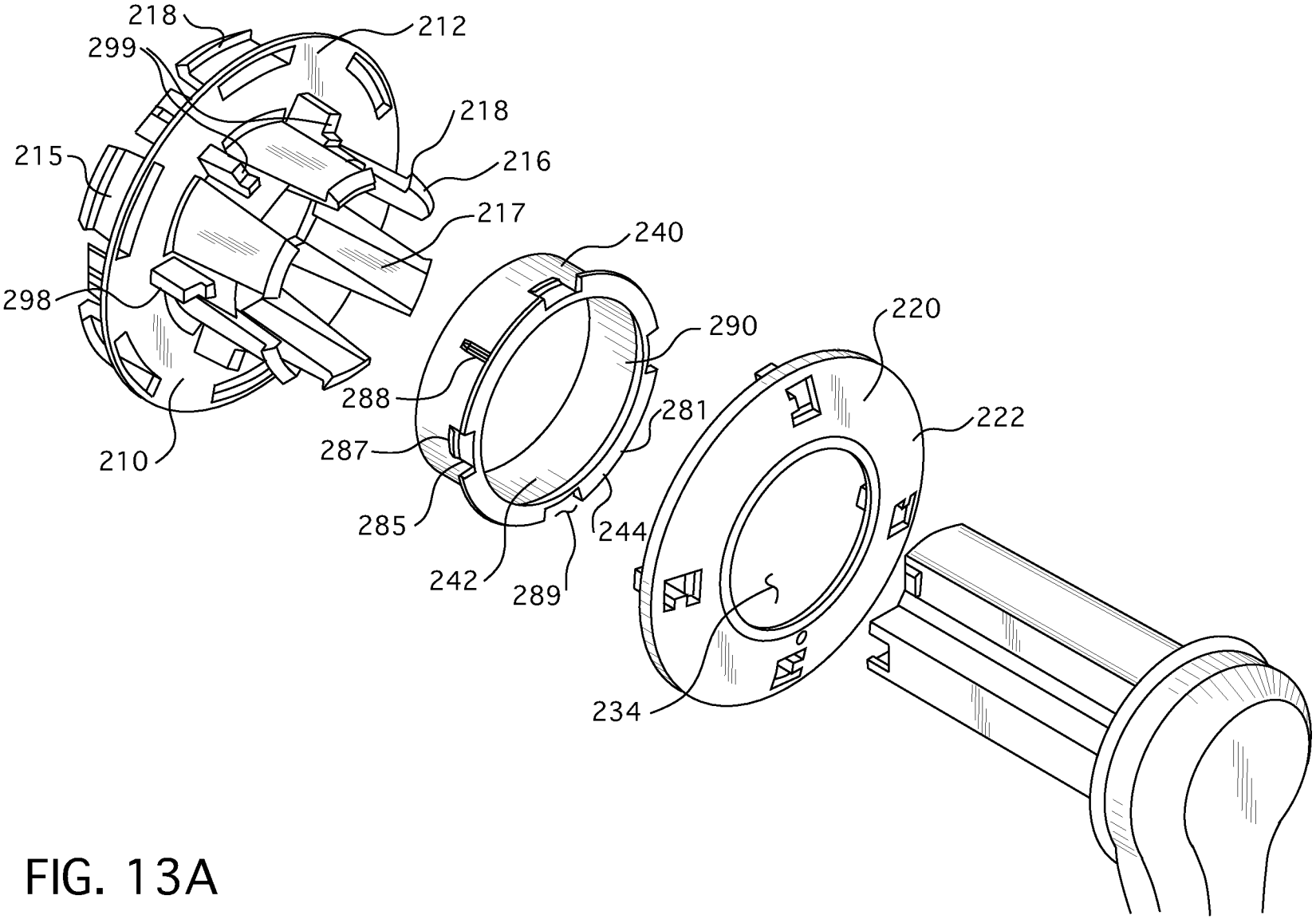
FIGS. 13A and 13B are detail views of portions of the basket assembly coupling assembly.
Figure 13B:
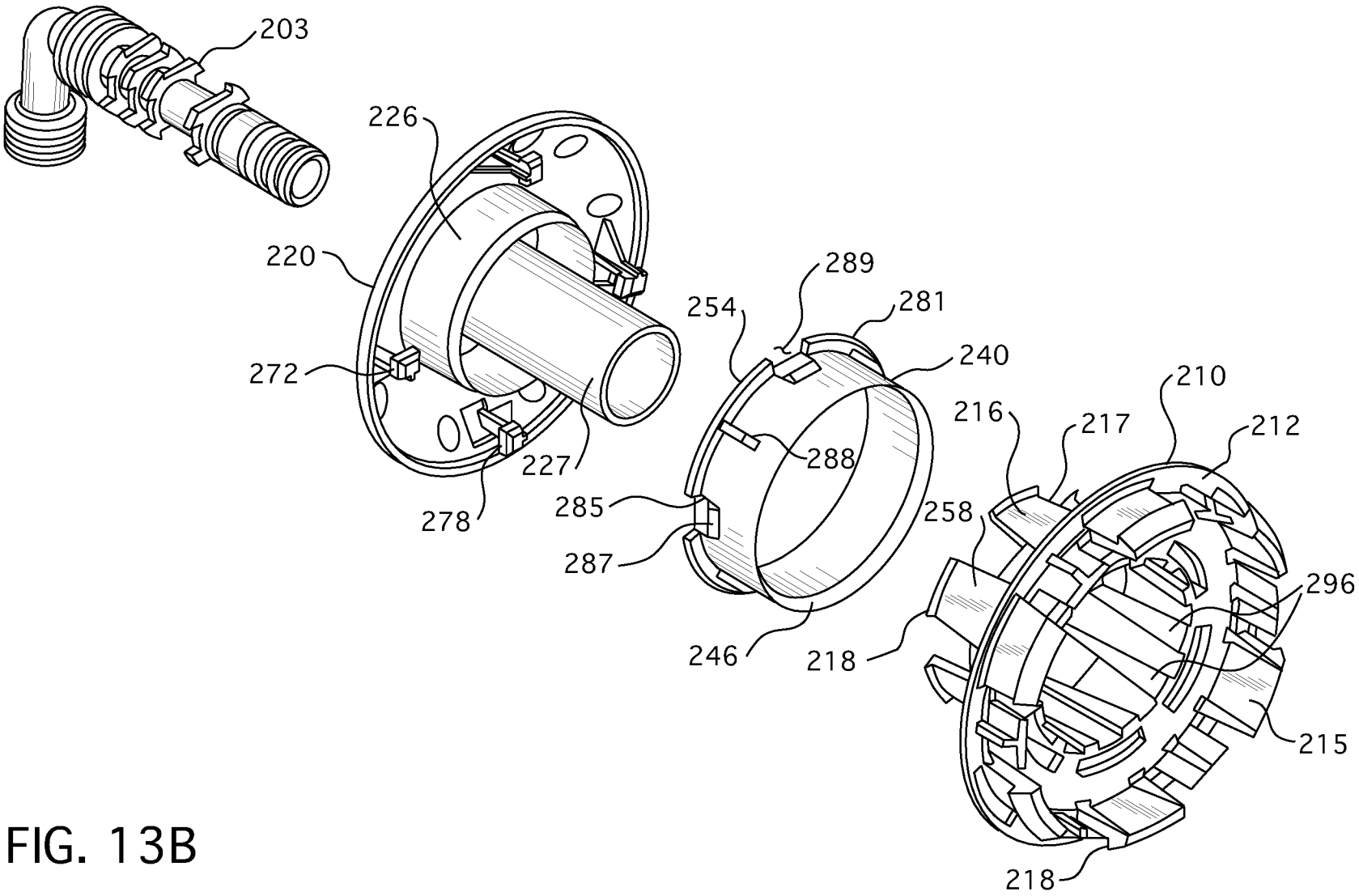

The bushing 240 is structured to be coupled to the housing assembly central opening 260. The basket assembly coupling assembly coupling components 250 of the bushing 240, i.e. the at least one bushing first coupling component 254, includes the bushing body outer axial end 244 having a flange 281 and, preferably, a latching member 283. The bushing body flange 281 is disposed at the distal end of the bushing body outer axial end 244. The bushing body flange 281 extends radially, that is generally perpendicular to the basket assembly axis of rotation 211. The bushing body flange 281 has a length, from inner radial edge to outer radial edge, of between about 0.25 inch and 0.375 inch, and, more preferably, of about 0.33 inch. The bushing body latching member 283 is, essentially, a second smaller, intermittent flange. As shown in FIGS. 13A and 13B, the bushing body latching member 283 has a radial latching surface 285 and an angled outer surface 287. The bushing body latching member 283 is near, but disposed inwardly of, the distal end of the bushing body outer axial end 244. That is, there is a gap between the bushing body flange 281 and the bushing body latching member latching surface 285. This gap is sized to be about the thickness of the unitary sidewall 22 or, if a vertical mounting surface 290 is used, about the thickness of the thick sidewall portion 292.

The bushing 240 is installed, typically, by moving the bushing body 242 through the housing assembly central opening 260 from outside the unitary sidewall 22 with the bushing body inner axial end 246 moving through the central opening 260 and the bushing body flange 281 being disposed on the outer side of the housing assembly central opening 260. In this configuration, the bushing body flange 281 is disposed adjacent, or engaging, the intermediate web 270. As with the shroud first coupling component head 276, the bushing body flange 281 engages and supports the adjacent intermediate web 270 when installed. It is noted that, in this configuration, the shroud first coupling component head 276 and the bushing body flange 281 are disposed on opposite sides of said intermediate web 270. Thus, the intermediate web 270 is supported on both the inner and outer sides.

The bushing 240 may further include at least one axial rib 288 disposed on the outer surface of the bushing body 242. The bushing axial rib 288 has a limited height above the outer surface of the bushing body 242, preferably less than 0.25 inch. The bushing axial rib 288 is structured to act as a key to prevent constant rotation of the bushing 240. That is, for each at least one bushing axial rib 288 there is a corresponding slot 289 disposed on the perimeter of each central opening 260. Each slot 289 is a portion of the central opening 260 having a slightly greater radius than the other portions of the central opening 260. Preferably, each slot 289 extends over an arc of about 10 degrees. When the bushing 240 is installed, each at least one bushing axial rib 288 is disposed in a corresponding slot 289. In this configuration, the bushing 240 may rotate slightly. That is, the bushing 240 may rotate until each at least one bushing axial rib 288 contacts the end of the associated slot 289. Thus, in the preferred embodiment, the bushing 240 may rotate over an arc of about seventeen degrees.

As noted above, when the shroud 220 and the bushing 240 are installed, the bushing 240 is disposed about, and spaced from, the shroud inner extension 226 thereby defining a partially enclosed space 248. To rotatably couple the basket end cap 210 to the unitary sidewall 22, the rotatable coupling spring clip bodies 217 are passed through the partially enclosed space 248 until the rotatable coupling spring clip latch surface 218 is disposed on the outer surface of the bushing body flange 281. That is, the rotatable coupling spring clip bodies 217 flex inwardly, i.e. toward the axis of the basket end cap 210, as the rotatable coupling spring clip bodies 217 are passed through the partially enclosed space 248. Once the rotatable coupling spring clip latch surfaces 218 pass through the partially enclosed space 248, the rotatable coupling spring clip bodies 217 return to their original configuration and the rotatable coupling spring clip latch surfaces 218 are disposed on the outer surface of the bushing body flange 281. In this configuration, the basket end cap 210 also indirectly engages and supports the adjacent intermediate web 270 when installed.

The basket end cap body 207 may include additional structures that assist with the rotation of the basket end cap 210. These include a set of intermittent axial ribs 296 (FIG. 13B) and a set of platform ribs 298 (FIG. 13A). The inwardly extending axial ribs 296 are disposed on the inner surface of the rotatable coupling spring clip bodies 217 and extend generally parallel to the axis of rotation 211. The axial ribs 296 may be disposed at the edges of the rotatable coupling spring clip bodies 217. In this configuration, the axial ribs 296 engage the outer surface of the shroud inner extension 226. Because the axial ribs 296 are intermittent, there is less than a continuous surface engaging the outer surface of the shroud inner extension 226, thus reducing friction. The platform ribs 298 are disposed on the outer surface of the rotatable coupling spring clip bodies 217 or, as shown, on axial platforms 299 disposed between the rotatable coupling spring clip bodies 217. The outer axial surface of the platform ribs 298 are structured to engage the bushing body inner axial end 246. The outer axial surface of the platform ribs 298 are spaced from the rotatable coupling spring clip latch surface 218 by a distance substantially equal to, but slightly greater than, the axial length of the bushing body 242. Thus, the bushing body 242 is disposed between the outer axial surface of the platform ribs 298 and the rotatable coupling spring clip latch surface 218. In this configuration, the basket end cap body 207 cannot move axially more than an insubstantial distance relative to the bushing 240.

It is noted that, because the unitary body 22 is upwardly tapered, if the basket assembly coupling assembly 205 were coupled directly thereto, i.e. the generally planar shroud member body 222 was disposed against one of the opposing planar members 33, 37 as discussed above, the basket assembly coupling assembly 205 would be slightly angled relative to a vertical axis. If the two opposing basket assembly coupling assemblies 205 are angled, the axis of rotation defined by the basket assembly coupling assemblies 205 is not straight. That is, it would not be an axis of rotation as the basket assembly coupling assemblies 205 would not be disposed on a common axis. This alignment issue may be addressed in at least two manners. First, a portion of the sidewall 22 may be adapted to provide a substantially vertical surface within the tapered sidewall planar members 33, 37. Second, the bushing body 242 may be keyed so that it may only be coupled to the unitary sidewall 22 in a single orientation, and, the outer surface of the bushing flange 281 may be tapered so that, when the bushing flange 281 is placed adjacent to the opposing planar members 33, 37, the bushing flange 281 extends in a substantially vertical plane.

With regard to the first configuration, the unitary sidewall 22 may include a mounting surface 290 on the unitary sidewall 22 and disposed about the at least one housing assembly second coupling components 256, see FIG. 16. The mounting surface 290 is a substantially vertical planar member. The mounting surface planar member 290 is thicker at the top than at the bottom and/or the bottom of the mounting surface 290 is offset inwardly from the unitary sidewall 22. That is, the mounting surface 290 includes one of, or both, a thick sidewall portion 292 or an offset portion 294 (FIG. 15). The amount of the inward offset and/or increased wall thickness compensates for the taper of the unitary sidewall 22, thereby allowing the mounting surface 290 to be substantially vertical. Preferably, the offset portion 294 is disposed proximate the lower area of the mounting surface 290 and the thick sidewall portion 292 is disposed proximate the upper area of the mounting surface 290. The degree of offset is greatest at the bottom of the mounting surface 290 and decreases at higher elevations at a rate commensurate with the degree of taper in the unitary body 22. Similarly, the thick sidewall portion 292 is thickest at the top of the mounting surface 290 and becomes thinner at lower elevations.

It is noted that, because much of the area in the mounting surface 290 is included in the at least one housing assembly second coupling components 256, i.e. the openings 260, 262, there is little difficulty removing the substantially vertical mounting surface 290 from the tapered molds. Further, the amount of offset and/or increased thickness is not so substantial as to diverge from the planar nature of the unitary body sidewalls 30, 32, 34, 36. That is, the increased wall thickness and/or offset cannot be more than about 0.15 inch. With such a minimal change in the planar nature of the unitary body sidewalls 30, 32, 34, 36, the mounting surface 290 does not act as a contoured surface that helps support the unitary body sidewalls 30, 32, 34, 36. That is, as used herein, the unitary body sidewalls 30, 32, 34, 36 are still "generally planar" or "substantially planar" members 31, 33, 35, 37, even with the mounting surface 290. It is noted that, in this configuration, the length of the shroud first coupling component stems 274 are substantially similar as the individual shroud first coupling components 252 may be oriented to engage a shroud coupling opening 262 at either the top, bottom, or medial elevation of the mounting surface 290.

Figure 15A:
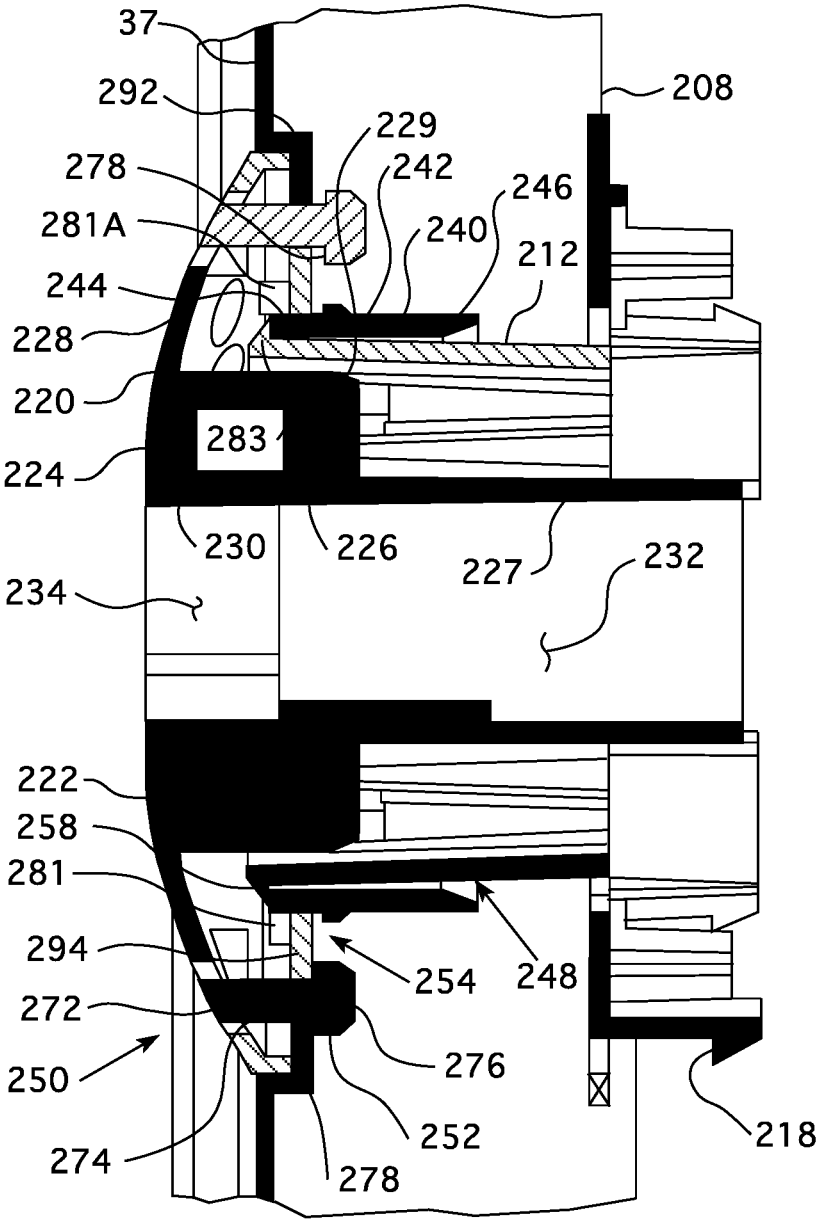
FIG. 15A is a cross-sectional view of an alternate embodiment of the basket assembly coupling assembly.

In an alternate embodiment, FIG. 15A, the requirement that the basket assembly coupling assembly 205 provide an axis of rotation that is substantially horizontal while mounted on an angled, i.e. upwardly tapered surface, is met by having the outer surface of the bushing flange 281 be angled relative to the opposing planar members 33, 37. That is, because the basket end caps 210 are coupled to the bushing 240, and more specifically to the outer surface of the bushing flange 281, if the two opposing bushing 240 outer surfaces define a substantially vertical planes, then the basket end caps 210 may be positioned so as to have a substantially horizontal axis of rotation. This is accomplished by providing a bushing flange 281A with a variable thickness, in a manner similar to the mounting surface 290 described above.

Generally, the bushing flange 281A is thicker at the top than at the bottom with, preferably, a gradual taper therebetween. The amount of taper on the bushing flange 281 substantially matches the taper of the unitary sidewall 22, with the bushing flange 281 being wider (thicker) at the top than at the bottom. Thus, when the bushing 240 is coupled to the tapered unitary sidewall 22, the inverse taper, i.e. taper in the opposite direction, of the bushing flange 281 is balanced relative to the tapered unitary sidewall 22. In this configuration, the outer surface of the bushing flange 281 is disposed in a substantially vertical plane. Thus, when the basket end caps 210 are coupled to the bushing body 240, as described above, the rotatable coupling spring clip latch surface 218 is disposed on the substantially vertical outer surface of the bushing flange 281. As noted above, the rotatable coupling spring clip latch surface 218 extends generally perpendicular to the rotatable coupling spring clip bodies 217. Thus, the rotatable coupling spring clip bodies 217 extend substantially horizontally. In this configuration, the axis of the basket assembly coupling assemblies 205 extend substantially horizontally.

To ensure the proper orientation of the bushing body 242, i.e. with the thick portion of the bushing flange 281 at the top, the bushing at least one axial rib 288 may be at least two axial ribs 288 disposed asymmetrically on the outer surface of the bushing body 242. The corresponding slots 289 disposed on the perimeter of the basket assembly mounting opening 209 are also disposed asymmetrically and are positioned so that the bushing body 242 may only be coupled to the basket assembly mounting opening 209 in the proper orientation, i.e. with the thicker portion of the bushing 240 disposed above the thinner portion.

As noted above, the structure of the basket assembly coupling assembly 205 is required when the unitary sidewall 22 is thin. That is, if the housing assembly sidewall was thick enough so as to not flex under the stress of winding the basket assembly 200, e.g. if the sidewall included support structures such as ribs or braces, the supporting basket assembly coupling assembly 205 would not be required. Thus, the basket assembly coupling assembly 205 is structured for unitary sidewalls wherein the intermediate web 270 has a thickness of between about 0.08 inch and 0.15 inch, and more preferably about 0.1 inch. Further, the overall width of the web 271, i.e. from a radial inner edge to a radial outer edge, is between about 0.75 inch and 1.0 inch, and more preferably about 0.875 inch. Further, the width of the intermediate web, that is, the distance between the housing assembly central opening 260 and the adjacent edge of the shroud coupling opening 262 at the seat 284, is between about 0.1875 inch and 0.375 inch, and more preferably about 0.25 inch. Preferably, the smallest radial distance between each shroud first coupling component head 276 and the bushing flange 281, i.e. the radial distance between the inner edge of the shroud first coupling component head 276 and the outer edge of the bushing flange 281 is between about 0.1875 inch and 0.25 inch, and more preferably about 0.2 inch.

Figure 17:
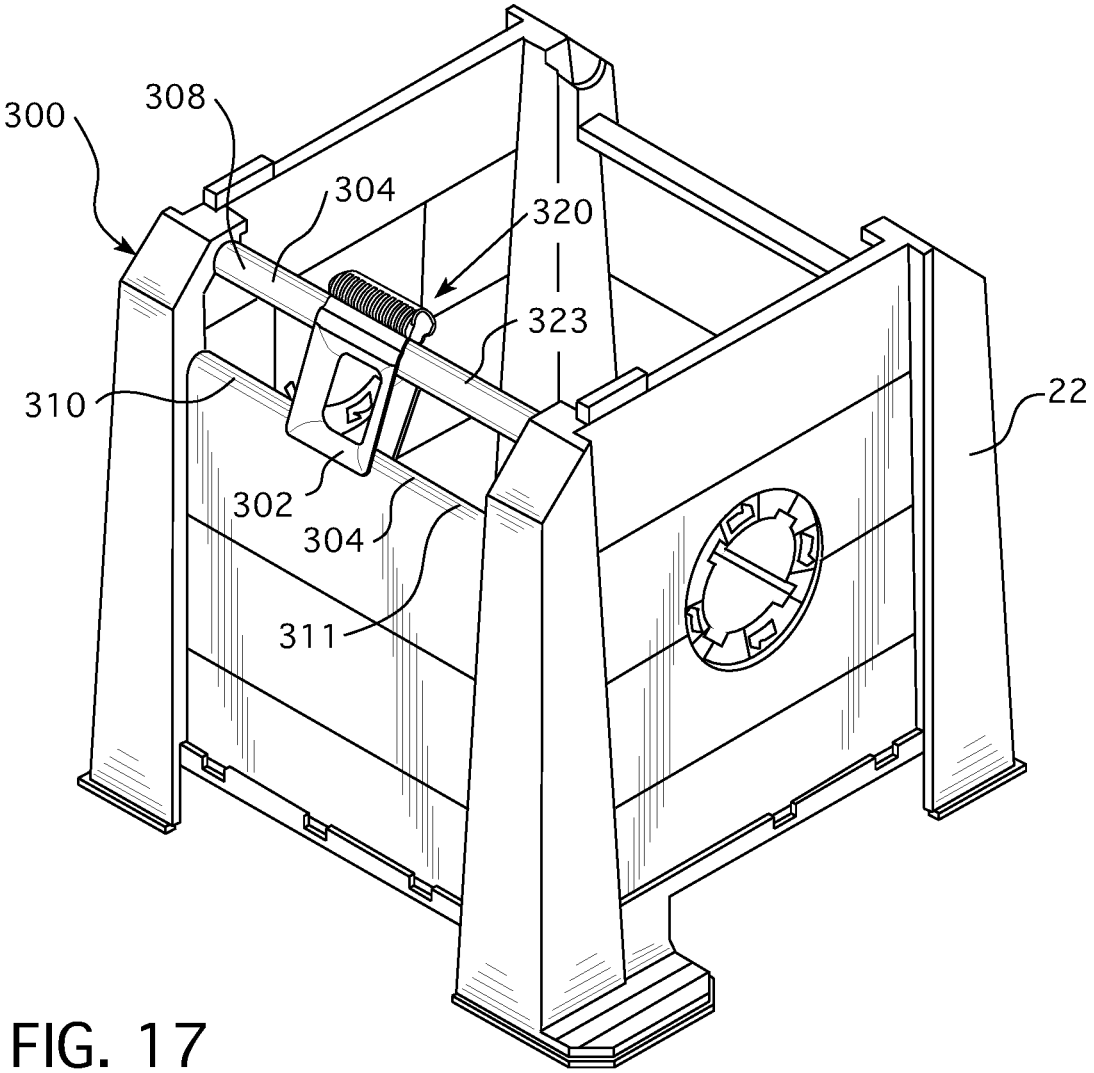
FIG. 17 is an isometric view of a hose guide system.

The housing assembly 12 further includes a hose guide system 300 including a hose guide 302 and at least one travel bar 304, as shown in FIG. 17. As described below, the hose 1 is structured to pass through the hose guide 302. The hose guide 302 is structured to be moved back-and-forth over a path having generally the same length as the barrel 202 and that is generally parallel to, but spaced from, the barrel 202. When the hose 1 is being wound about the barrel 202, the hose guide 302 is moved back-and-forth causing the wound hose 1 to be generally evenly distributed across the barrel body 206. The at least one travel bar 304 defines the path over which the hose guide 302 travels.

The at least one travel bar 304 is unitary to the housing component 20. The at least one travel bar 304 preferably has two travel bars 308, 310. The travel bars 308, 310 extend generally parallel to the axis of rotation of the basket assembly 200 and are disposed in a spaced, generally parallel configuration. The travel bars 308, 310 are sized to fit within, or define, the travel bar passages 322 (discussed below) of the hose guide 302. Preferably, the travel bars 308, 310 have a cross-sectional area slightly smaller than the travel bar passages 322 whereby the hose guide 302 may move freely over the travel bars 308, 310 but not so small that the hose guide 302 may wobble or otherwise be loosely coupled to the unitary sidewall 22. The travel bars 308, 310 are elongated with a length substantially equal to the length of front sidewall 30. The travel bars 308, 310 have a cross-sectional area, e.g. a diameter, between about 0.75 inch and 1.25 inch and preferably about 1.0 inch. That is, the travel bars 308, 310 preferably have an aspect ratio generally near 1.0 and are, preferably, not thin members.

The upper first travel bar 308 is disposed near the upper side of the unitary sidewall 22. The upper travel bar 308, preferably, has a generally smooth surface. It is noted that, due to molding considerations, the upper travel bar 308 may include a portion resembling spaced disks disposed on a common axis. In this configuration, the edges of the disks are substantially parallel. The lower second travel bar 310 is, preferably, a generally arcuate edge or surface 311 of the unitary sidewall 22, preferably disposed at the upper side of the front sidewall 30. As noted above, the front sidewall 30 has a portal 28 through which the hose 1 passes. The lower travel bar 310 extends along the lower edge of the portal 28. The lower travel bar 310 is unitary with the unitary sidewall 22 and is molded/formed as part of planar member 31. In the preferred embodiment, the arcuate surface 311 is, preferably, generally smooth. It is noted that, in an alternate embodiment, the lower travel bar 310 includes a race 312 (FIG. 18) that is used to contain a cam a projection 314, as described below.

Figure 18:
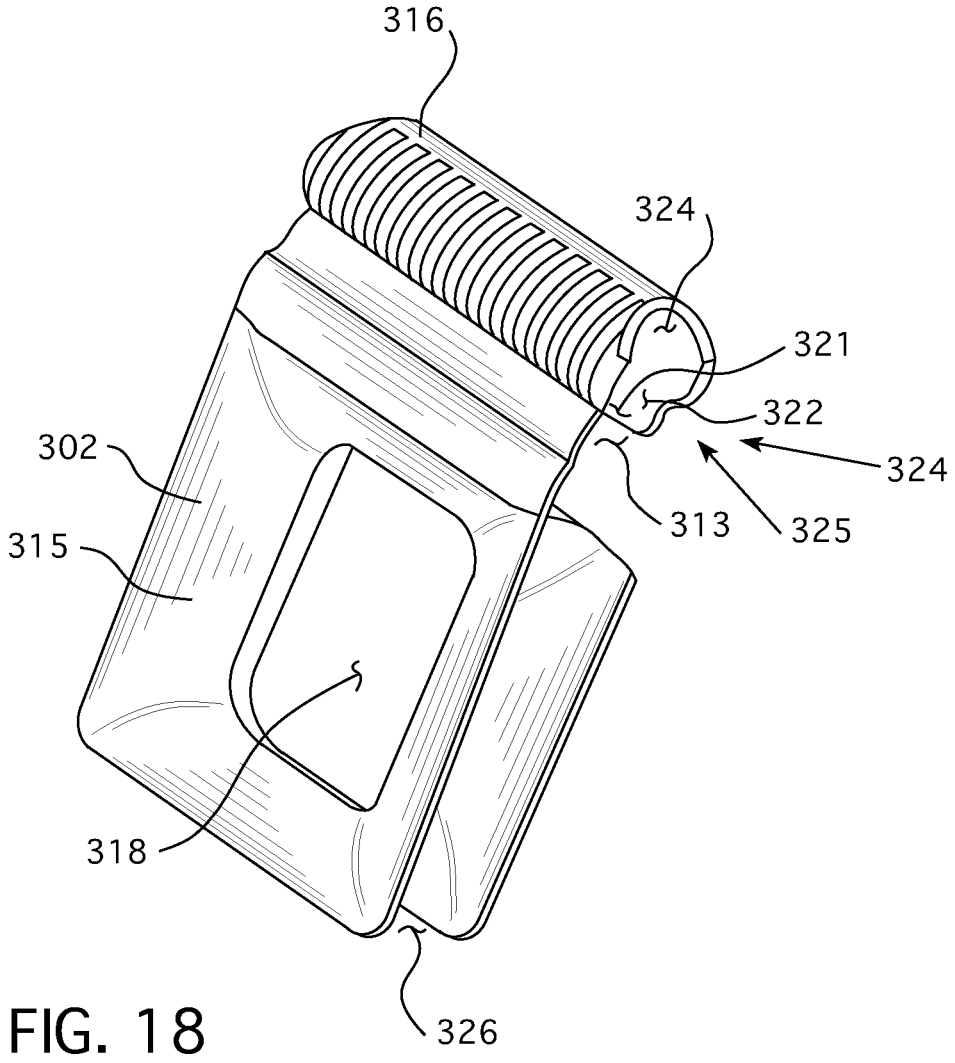
FIG. 18 is an isometric detail view of a hose guide.

As shown in FIG. 18, the hose guide 302 is a unitary body 315. Preferably, the hose guide body 315 is generally planar and rectangular. The hose guide body 315 may have a handle 316. The hose guide body 315 has a hose passage 318 sized to allow the hose 1 to pass therethrough. The hose guide body 315 has a thickness between 0.08 inch and 0.15 inch and preferably 0.1. The hose passage 318 has an axis that is generally normal to the plane of the hose guide body 315. The hose guide body 315 is made from a material structured to be minimally flexible or to be minimally compressed, such as, but not limited to, PP (Polypropylene), PE (Polyethylene), ABS, Polyoxymethylene (Acetal).

The hose guide body 315 is coupled to the unitary sidewall 22 by at least one slidable coupling device 320. As noted above, a coupling device 90 has a first and second component 92, 94; the at least one slidable coupling device 320 includes a slidable coupling device first component 323 and a slidable coupling device second component 325. The slidable coupling device first component 323 is disposed on the unitary body 22 and the slidable coupling device second component 325 is disposed on the hose guide body 315. That is, the slidable coupling device first component 323 includes at least one travel bar 304, discussed above, and the slidable coupling device second component 325, preferably, includes a semi-enclosed passage 321 on the hose guide body 315. The semi-enclosed passage 321, preferably, is the at least one travel bar passage 322.

The at least one slidable coupling device 320 has at least a first, second, and third embodiment. The first, and preferred, embodiment of the at least one slidable coupling device 320 includes as the slidable coupling device second component 325 an upper first travel bar passage 324 and a lower second travel bar passage 326. The travel bar passages 324, 326 are preferably elongated, but may also be defined by two or more toruses, i.e. rings (not shown), disposed along a generally common axis. The upper and lower travel bar passages 324, 326 each have an axis. The upper and lower travel bar passage 324, 326 axes are substantially parallel. The axis of the upper and lower travel bar passages 324, 326 are, preferably, substantially parallel to the basket assembly 200 axis of rotation 211. The slidable coupling device first component 323 are the travel bars 308, 310, as noted above.

The upper travel bar passage 324 is structured to be coupled to the upper travel bar 308. The lower travel bar passage 326 is structured to be coupled to the lower travel bar 310. Preferably, the travel bar passages 324, 326 are "semi-enclosed" passages 321. A semi-enclosed passage 321 is a passage having a gap 313 extending longitudinally over the length of the passage. The gap 313 is narrower than the diameter, or width, of the semi-enclosed passage 321. That is, the semi-enclosed passage 321 is, preferably, a generally circular passage, but a passage of any cross-sectional shape may be used. Further, the semi-enclosed passage 321, preferably, has a cross-sectional shape that corresponds substantially to the cross-sectional shape of the associated at least one travel bar 304, which is also generally circular in the preferred embodiment. Thus, the interior surface of the semi-enclosed passage 321 is, preferably, generally "C" shaped, i.e. the semi-enclosed passage 321 has a C-shaped cross-section. In this configuration, and when the material defining the semi-enclosed passage 321 is at least minimally flexible, the semi-enclosed passage 321 acts as a snap-fit coupling. That is, the gaps 313 of the upper and lower travel bar passages 324, 326 are structured to widen temporarily so as to be wider than the cross-sectional area, e.g. diameter, of the travel bars 308, 310. Each second component 325 of the at least one slidable coupling device 320, i.e. the travel bar passages 324, 326, is structured to snap-fit onto the first component 323 of the at least one slidable coupling device 320, i.e. the travel bars 308, 310. Thus, the slidable coupling device second component 325 is structured to be snap-fitted to the slidable coupling device first component 323.

Thus, upon installation, the travel bar passages 324, 326 capture the travel bars 308, 310 in a snap-fit manner. That is, each travel bar 308, 310 is structured to be moved into the semi-enclosed passage gap 313 causing the semi-enclosed passage gap 313 to temporarily widen as the travel bar 308, 310 moves therethrough. As the travel bar 308, 310 slides completely into the travel bar passage 324, 326, the gap 313 returns to the original width, i.e. a width smaller than the cross-sectional area, e.g. diameter, of the travel bars 308, 310. In this configuration, each travel bar 308, 310 will be disposed, and maintained, in the travel bar passage 324, 326. Further, in this configuration, the at least one travel bar passage 322 does not encircle the associated at least one travel bar 304. That is, as used herein, "encircle" means to extend completely about. Thus, due to the gap 313, the at least one travel bar passage 322 does not extend completely about the associated at least one travel bar 304. Further, in a more preferred embodiment, neither travel bar passage 324, 326 encircles the associated travel bar 308, 310.

Figure 19:
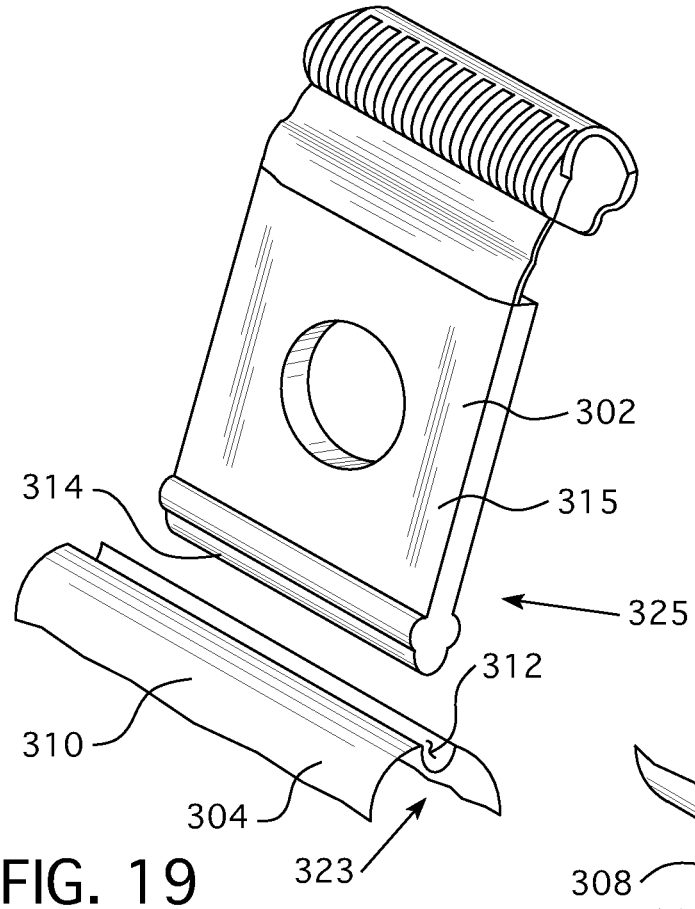
FIG. 19 is an isometric detail view of another hose guide.

In the second embodiment, shown in FIG. 19, the at least one slidable coupling device first component 323 includes an upper travel bar 308 and a lower travel bar 310 having a race 312. The lower travel bar race 312 extends over substantially the entire length of the lower travel bar 310. The lower travel bar race 312 may be formed therein, or, cut after the lower travel bar 310 has been molded. The at least one slidable coupling device 320 first component 323 includes a travel bar passage 322, as described above, structured to engage the upper travel bar 308 and a projection 314. The projection 314 is disposed on the lower side of the hose guide body 315 and, when installed, faces, i.e. is disposed adjacent to, the lower travel bar 310. The projection 314 is structured to be slidably disposed in the race 312. It is noted that the travel bars 308, 310 are spaced and the longitudinal axes of the travel bars 308, 310 generally define a plane, hereinafter the "hose guide body plane." The race 312 is positioned on the lower travel bar 310 so as to be substantially disposed in the hose guide body plane.

The upper travel bar passage 324 is a semi-enclosed passage and is structured to be coupled to the upper travel bar 308 as described above. During installation of the hose guide body 315 on the unitary sidewall 22, the projection 314 is structured to be slidably disposed in the race 312 of the lower travel bar 310 first. Then, the upper travel bar passage 324 captures the upper travel bar 308 in a snap-fit manner.

Figure 20:
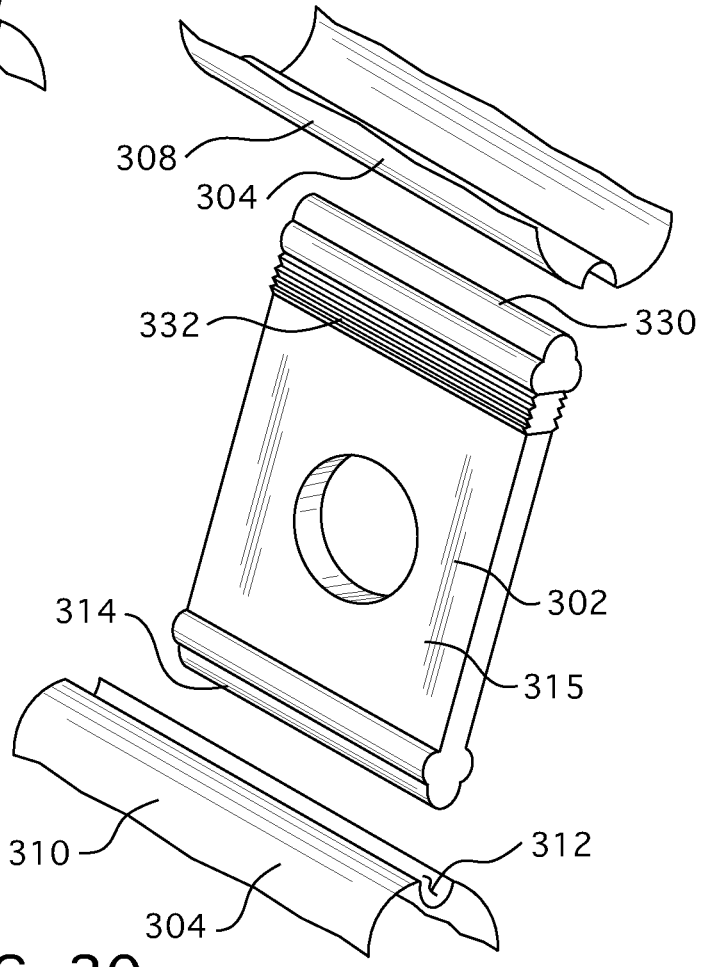
FIG. 20 is an isometric detail view of another hose guide.

As shown in FIG. 20, the third embodiment of the at least one slidable coupling device first components 323 include the upper and lower travel bars 308, 310, each having a race 312. As noted above, there is a hose guide body plane. The races 312 are positioned on the travel bars 308, 310 so as to be substantially disposed in the hose guide body plane. The at least one slidable coupling device second component 325 includes an upper and lower projection 330, 314. The upper projection 330 is structured to be slidably disposed in the race 312 of the upper travel bar 308. The lower projection 314 is structured to be slidably disposed in the race 312 of the lower travel bar 310. The third embodiment utilizes a hose guide body 315 that is sized to just fit between the travel bars 308, 310, i.e. within the housing assembly hose portal 28. Further, the hose guide body 315 is structured to be minimally flexible. That is, the hose guide body 315 is structured to be compressed to a size smaller than the housing assembly hose portal 28 between the upper and lower travel bars 308, 310. The hose guide body 315 may be made from a compressible material, or, may include a resilient, spring-like portion 332. Thus, the hose guide body 315 is structured to be compressed and positioned within the housing assembly hose portal 28. Upon release, the hose guide body 315 is structured to return to the original shape, thereby positioning the upper projection 330 in the upper travel bar race 312, and the lower projection 314 in the lower travel bar race 312. An alternate embodiment would have the races 312 substantially disposed in the hose guide body plane but where the race 312 on the upper travel bar 308 is facing away from the race 312 on the lower travel bar 310. This alternate embodiment would not utilize a hose guide body 315 that is structured to flex. Instead, the upper projection 330 would be disposed on an arm or similar construct (not shown) structured to extend around the upper travel bar 308 so that the upper projection 330 may be slidably disposed in the race 312. It is noted that the bias is created by the minimally flexible hose guide body 315 that biases the projections 314 into the upper travel bar race 312 and the lower travel bar race 312. Thus, the slidable coupling device second component 325 is structured to be snap-fitted to the slidable coupling device first component 323.

Upon assembly, the slidable coupling device 320 attaches to the unitary housing assembly 20 as follows. In the first and preferred embodiment, the travel bar passages 324, 326 capture the travel bars 308, 310 in a snap-fit manner. That is, the hose guide body 315, and more specifically the travel bar passages 324, 326, are biased against the travel bars 308, 310 whereupon the travel bar passage gaps 313 spread temporarily so as to be wider than the cross-sectional area, e.g. diameter, of the travel bars 308, 310. Each travel bar 308, 310 then slides completely through the associated travel bar passage gap 313 into the travel bar passages 324, 326. The travel bar passage gap 313 then returns to its original configuration, i.e. to a width smaller than the cross-sectional area or diameter of the travel bars 308, 310, thus trapping the travel bars 308, 310 in the travel bar passages 324, 326. As noted above, the travel bar passages 324, 326 are slightly larger than the travel bars 308, 310; thus, the hose guide body 315 is slidably disposed on the travel bars 308, 310 and may be moved back-and-forth thereover. That is, the hose guide body 315 is slidably coupled to the unitary sidewall 22 and may be moved back and forth within the housing assembly portal 28.

In the second embodiment, the hose guide body 315 is slidably disposed on the travel bars 308, 310 by, initially, disposing the projection 314 in the lower travel bar race 312. Then the upper travel bar passage 324 captures the upper travel bar 308 in a snap-fit manner as described above. Thus, the projection 314 is slidably disposed in the lower travel bar race 312 and the upper travel bar 308 is slidably disposed in the upper travel bar passage 324. In this configuration, the hose guide body 315 is slidably coupled to the unitary sidewall 22 and may be moved back and forth within the housing assembly portal 28.

In the third embodiment, the hose guide body 315 is compressed to a size smaller than the housing assembly hose portal 28 between the upper and lower travel bars 308, 310. Upon release, the hose guide body 315 returns to its original configuration and the upper projection 330 is slidably disposed in the race 312 of the upper travel bar 308, and the lower projection 314 is slidably disposed in the race 312 of the lower travel bar 310. In this configuration, the hose guide body 315 is slidably coupled to the unitary sidewall 22 and may be moved back-and-forth within the housing assembly portal 28.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A hose guide for a hose reel deck box, said hose reel deck box including a housing assembly and a basket assembly, said housing assembly including a unitary housing component with a unitary sidewall defining an enclosed space, said unitary sidewall having a plurality of substantially planar members and first and second travel bars, the second travel bar being formed along an edge upon a surface of the unitary sidewall, unitary with the unitary sidewall, and parallel with the unitary sidewall; two opposing of said planar members having a housing assembly central opening therein, said basket assembly including an elongated barrel, said barrel having an axis of rotation, said barrel rotatably disposed in said unitary sidewall enclosed space, said first and second travel bars extending generally parallel to the axis of rotation of said barrel, said hose guide comprising:

a slidable coupling device including the first travel bar as an upper slidable coupling device first component, the second travel bar as a lower slidable coupling device first component, and upper and lower slidable coupling device second components, wherein:

a body defining a hose passage and said upper and lower slidable coupling device second components;

said upper and lower slidable coupling device second components structured to be slidably disposed to said first and second travel bars, respectively;

wherein said first and second travel bars are disposed in a spaced, generally parallel configuration, and wherein said first and second travel bars each include a race disposed within an engagement surface of each of the first and second travel bars, said races being disposed substantially within a plane of said hose guide body, and wherein:

said slidable coupling device includes a first projection and a second projection and wherein said body is structured to be compressed; and said first and second projections structured to be slidably disposed in said races.

2. The hose guide of claim 1 wherein said body is a unitary body.

3. The hose guide of claim 1 wherein said upper and lower slidable coupling device second components do not encircle said first and second travel bars.

4. The hose guide of claim 1, wherein the race of the first travel bar extends over substantially an entire length of the first travel bar.

5. The hose guide of claim 1, wherein the race of the second travel bar extends over substantially an entire length of the second travel bar.

6. The hose guide of claim 1, wherein the upper slidable coupling device second component is constructed as an upper projection and wherein the lower slidable coupling device second component is constructed as a lower projection.

7. The hose guide of claim 1, wherein the body is constructed of a resilient material such that the body is constructed to be compressed upon application of force, but to return to an original shape of the body upon release of the force.

8. A hose reel deck box comprising:

a housing assembly and a basket assembly;

said housing assembly including a unitary housing component with a unitary sidewall defining an enclosed space, said unitary sidewall having a plurality of substantially planar members and first and second travel bar, said second travel bar being formed along an edge upon a surface of the unitary sidewall, unitary with the unitary sidewall, and parallel with the unitary sidewall; two opposing of said planar members having a basket assembly mounting opening therein;

said basket assembly including an elongated barrel, said barrel having an axis of rotation, said barrel rotatably disposed in said unitary sidewall enclosed space;

said first and second travel bars extending generally parallel to the axis of rotation of said barrel;

a hose guide having a selectively compressible body, and a slidable coupling device; said hose guide body defining a hose passage and the first travel bar as an upper slidable coupling device first component, the second travel bar as a lower slidable coupling device first component, and upper and lower slidable coupling device second components;

said body of said hose guide structured to be selectively compressible to position said slidable coupling device between said first and second travel bars, said slidable coupling device engaging said first and second travel bars when said slidable coupling device is released from compression;

wherein said first and second travel bars are disposed in a spaced, generally parallel configuration, and wherein said first and second travel bars each include a race disposed within an engagement surface of each of the first and second travel bars, said races being disposed substantially within a plane of said hose guide body, and wherein:

said upper and lower slidable coupling device second components include a first projection and a second projection, respectively; and wherein said first and second projections are structured to be slidably disposed in said races.

9. The hose reel deck box of claim 8, wherein said upper and lower slidable coupling device second components are structured to be slidably disposed to said first and second travel bars, respectively.

10. The hose reel deck box of claim 8 wherein at least one of said first and second travel bars is unitary with said unitary housing component.

11. The hose reel deck box of claim 8 wherein said body is a unitary body.

12. The hose reel deck box of claim 8 wherein said slidable coupling device second components do not fully encircle said first and second travel bars.

13. A hose guide for a hose reel deck box, said hose reel deck box including a housing assembly and a basket assembly, said housing assembly including a unitary housing component with a unitary sidewall defining an enclosed space, said unitary sidewall having a plurality of substantially planar members and first and second travel bars, the second travel bar being formed along an edge of and unitary with the unitary sidewall; two opposing of said planar members having a housing assembly central opening therein, said basket assembly including an elongated barrel, said barrel having an axis of rotation, said barrel rotatably disposed in said unitary sidewall enclosed space, said first and second travel bars extending generally parallel to the axis of rotation of said barrel, said hose guide comprising:

a slidable coupling device including the first travel bar and the second travel bar as upper and lower slidable coupling device first components, and upper and lower slidable coupling device second components, wherein:

a body defining a hose passage and said upper and lower slidable coupling device second components;

said upper and lower slidable coupling device second components structured to be slidably disposed to said first and second travel bars, respectively;

wherein said first and second travel bars are disposed in a spaced, generally parallel configuration, and wherein said first and second travel bars each include a race disposed within an engagement surface of each of the first and second travel bars, said races being disposed substantially within a plane of said hose guide body, and wherein:

said slidable coupling device includes a first projection and a second projection and wherein said body is structured to be compressed; and said first and second projections structured to be slidably disposed in said races.

14. The hose guide of claim 13 wherein said body is a unitary body.

15. The hose guide of claim 13 wherein said upper and lower slidable coupling device second components do not encircle said first and second travel bars.

16. The hose guide of claim 13, wherein the race of the first travel bar extends over substantially an entire length of the first travel bar.

17. The hose guide of claim 13, wherein the race of the second travel bar extends over substantially an entire length of the second travel bar.

18. The hose guide of claim 13, wherein the upper slidable coupling device second component is constructed as an upper projection and wherein the lower slidable coupling device second component is constructed as a lower projection.

* * * * *